US005882479A

United States Patent [19]

Oriaran et al.

[11] Patent Number: 5,882,479

[45] Date of Patent: Mar. 16, 1999

[54] SOFT SINGLE-PLY TISSUE HAVING VERY LOW SIDEDNESS

[75] Inventors: T. Philips Oriaran, Appleton; Frank D. Harper, Neenah; Anthony O. Awofeso, Appleton; Cristian M. Neculescu, Neenah; Phuong Van Luu, Appleton; Thomas N. Kershaw, Neenah; Galyn A. Schulz, Greenville, all of Wis.

[73] Assignee: Fort James Corporation, Deerfield, Ill.

[21] Appl. No.: 910,639

[22] Filed: Aug. 13, 1997

Related U.S. Application Data

[62] Division of Ser. No. 223,392, Apr. 1, 1994, Pat. No. 5,695, 607.

[51] Int. Cl.[6] ..... D21H 27/38

[52] U.S. Cl. ..... 162/112; 162/113; 162/125; 162/127; 162/129; 162/130; 162/147; 162/149; 162/158; 162/164.1; 162/179

[58] Field of Search ..... 162/111, 112, 162/113, 129, 130, 131, 132, 109, 158, 164.1, 125, 127, 179, 147, 149

[56] References Cited

U.S. PATENT DOCUMENTS

| | | | |
|---|---|---|---|
| 3,096,228 | 7/1963 | Day et al. | 162/112 |
| 3,507,745 | 4/1970 | Fuerst | 162/112 |
| 3,879,257 | 4/1975 | Gentile et al. | 162/112 |
| 4,063,995 | 12/1977 | Grossman | 162/112 |
| 4,166,001 | 8/1979 | Dunning et al. | 162/112 |
| 4,208,459 | 6/1980 | Becker et al. | 162/112 |
| 4,448,638 | 5/1984 | Klowak | 162/112 |
| 4,482,429 | 11/1984 | Klowak | 162/112 |
| 4,802,928 | 2/1989 | Dunlap | 162/112 |
| 4,883,564 | 11/1989 | Chen et al. | 162/112 |
| 4,894,118 | 1/1990 | Edwards et al. | 162/112 |
| 4,919,756 | 4/1990 | Sawdai | 162/112 |
| 4,940,513 | 7/1990 | Spendel | 162/112 |
| 4,959,125 | 9/1990 | Spendel | 162/112 |
| 5,087,324 | 2/1992 | Awofeso et al. | 162/112 |
| 5,164,045 | 11/1992 | Awofeso et al. | 162/112 |
| 5,164,046 | 11/1992 | Ampulski et al. | 162/112 |
| 5,178,729 | 1/1993 | Janda | 162/112 |
| 5,187,219 | 2/1993 | Furman | 162/112 |
| 5,234,547 | 8/1993 | Knight et al. | 162/112 |

FOREIGN PATENT DOCUMENTS

| | | |
|---|---|---|
| 496524 | 1/1992 | European Pat. Off. . |
| 9302252 | 2/1993 | WIPO . |

*Primary Examiner*—Peter Chin

[57] ABSTRACT

A one-ply paper tissue product and a method of making a one-ply paper product combining high strength and softness along with low sidedness. The paper tissue product exhibits a sidedness parameter of less than 0.3 preferably, less than 0.225, a tensile modulus of no more than 32 grams/percent strain, a GM MMD of no more than about 0.225, and a cross directional strength of at least 200 grams per 3 inches. In stratification tissues, these properties are obtained by control of stratification, particularly, chemical stratification and stratification of furnish when appropriate. The tissue has a sidedness parameter value of less than 0.3, preferably, about 0.15 to about less than 0.225. In homogenous tissue, these properties are obtained by adding a strength enhancing agent to separate furnish sources prior to the funish sources being combined, and further, optionally adding the softener to the nascent web.

21 Claims, 24 Drawing Sheets

Tissue is a three layered structure, and foam formed. Tissue embossed with TI pattern at penetration depth of 0.073"

Tissue is water formed and embossed with TI
Pattern at 0.090 penetration depth

Tissue is single layered and water formed.
Tissue embossed with TI pattern at
penetration depth of 0.090"

SOFT SINGLE-PLY TISSUE HAVING VERY LOW SIDEDNESS

This application is a division of application Ser. No. 08/223,392, filed Apr. 1, 1994 now U.S. Pat. No. 5,695,607.

BACKGROUND OF THE INVENTION

Through air drying has become the technology of preference for making tissue for many manufacturers who build new tissue machines as, on balance, through air drying ("TAD") offers many economic benefits as compared to the older technique of conventional wet-pressing ("CWP"). With through air drying, it is possible to produce a single ply tissue with good initial softness and bulk as it leaves the tissue machine.

In the older wet pressing method, to produce a premium quality tissue, it has normally been preferred to combine two thin plies by embossing them together. In this way, the rougher air-side surfaces of each ply may be joined to each other and thereby concealed within the sheet. However, embossing two plies together imposes marked economic penalties which can be avoided in production of a one-ply product using through air drying. But even though through air drying has been preferred for new machines, conventional wet pressing is not without its advantages as well. Water may normally be removed from a cellulosic web at lower energy cost by mechanical means such as by overall compaction than by drying using hot air. It is not normally economic to convert older CWP tissue machines to TAD. Further, single ply machines can normally run at high speeds.

What has been needed in the art is a method of making a premium quality or near premium quality single ply tissue using conventional wet pressing. In this way, advantages of each technology could be combined so older CWP machines can be used to produce high quality single ply tissue at costs which are far lower than those associated with embossing two plies together.

One of the more significant barriers to production of a single ply CWP tissue has been the extreme sidedness of single ply webs using technology known prior to this invention. TAD processes can produce a nice soft bulky sheet having fairly low strength and good similarity of the surface texture on the front of the sheet as compared to the back. Having the same texture on front and back is considered to be quite desirable in these products or, more precisely, having differing texture is generally considered quite undesirable.

We have found that we can produce a soft high strength CWP tissue with low sidedness by judicious combination of several techniques as described herein. Basically, these techniques fall into four categories: (i) fiber stratification; (ii) chemical stratification; (iii) low angle, high adhesion creping; and (iv) reverse embossing. Of these four techniques, the first two seem to be more flexible and exhibit more pronounced benefits than the latter two, but by various combinations of these techniques as described, taught and exemplified herein, it is possible to almost "dial in" the required degree of sidedness depending upon the desired goals.

CWP processes can be carried out on fourdrinier, twin wire, suction breast roll, and crescent forming machines. Energy consumption is lower and the production speeds can be considerably higher than those used on TAD machines. The plies previously produced on CWP machines are usually fairly strong but, as mentioned, they have a distinctly two-sided character; consequently, CWP is most commonly used for two-ply products so that the softer sides of each ply can be positioned on the exterior of each sheet and the harsher surfaces buried in the interior, each facing the other. However, there is a substantial cost penalty involved in the production of two-ply products because the parent rolls of each ply are not always of the same length, and a break in either of the single plies forces the operation to be shut down until it can be remedied. Further, CWP plies in a multi-ply structure need to be embossed to bond the plies together and help restore some of the bulk squeezed out in the pressing operation used to dewater each ply. For these reasons, many single-ply CWP products currently found in the marketplace are typically low end products. These products often are considered deficient in thickness, softness, and exhibit excessive two sidedness. Accordingly, these products have had rather low consumer acceptance and are typically used in "away from home" applications in which the person buying the tissue is not the user.

FIELD OF THE INVENTION

The present invention is directed to a soft, single-ply bulky tissue paper having low sidedness and processes for the manufacture of such tissue.

DESCRIPTION OF BACKGROUND ART

Paper is generally manufactured by suspending cellulosic fiber of appropriate geometric dimensions in an aqueous medium and then removing most of the liquid. The paper derives some of its structural integrity from the mechanical arrangement of the cellulosic fibers in the web, but most by far of the paper's strength is derived from hydrogen bonding which links the cellulosic fibers to one another. With paper intended for use as bathroom tissue, the degree of strength imparted by this inter-fiber bonding, while necessary to the utility of the product, can result in a lack of perceived softness that is inimical to consumer acceptance. One common method of increasing the perceived softness of bathroom tissue is to crepe the paper. Creping is generally effected by fixing the cellulosic web to a Yankee drum thermal drying means with an adhesive/release agent combination and then scraping the web off the Yankee by means of a creping blade. Creping, by breaking a significant number of inter-fiber bonds adds to and increases the perceived softness of resulting bathroom tissue product.

However, creping alone may not be sufficient to impart the optimum degree of softness to the bathroom tissue. Therefore, as related by Soerens et al. in U.S. Pat. No. 4,795,530, compounds such as quaternary amines that function as debonding agents are often incorporated into the paper web. As Soerens points out, cationic quaternary amines can be added to the initial fibrous slurry from which the paper web is subsequently made. Soerens teaches that it is preferable, however, to spray the chemical debonding agent onto the cellulosic web, after it is formed but before it is dried, and describes a method for spraying the amines onto the partially dewatered web in such a way that it is alleged the amines penetrate no more than 40% of the way through the thickness of the web leaving the remainder of the thickness "effectively untreated".

One-ply bathroom tissue generally suffers from the problem of "sidedness"—that is, one side of the sheet is generally perceived as being appreciably less soft than the other side. Sidedness is introduced into the sheet during the manufacturing process. The side of the sheet that was adhered to the Yankee and creped off i.e., the Yankee side is generally softer than the "air" side of the sheet. This two-sidedness is seen both in sheets that have been pressed to remove water and in unpressed sheets that have been subjected to vacuum and hot air (through-drying) prior to being adhered to the crepe dryer. The sidedness is present even after treatment with a softener. An acceptable one-ply tissue should not only be soft and strong but should also exhibit softness of each side approaching the softness of the other. The prior CWP art has been unable to solve this problem.

The most pertinent prior art patents will be discussed but, in our view, none of them can be fairly said to apply to reduction of sidedness in one-ply tissue nor to teach or make obvious use of combinations of the four basic techniques described above for reduction of sidedness.

The Furman et al. U.S. Pat. No. 5,187,219 discloses a polyacrylamide creping adhesive. The Grossman U.S. Pat. No. 4,063,995 discloses a four-component creping adhesive. The Knight et al. U.S. Pat. No. 5,234,547 discloses polyacrylamide as a creping aid.

The Ampulski et al. U.S. Pat. No. 5,164,046 and Publication WO 09302252 disclose a creping angle of 83°. Polyvinyl alcohol is the creping adhesive. The Edwards et al. U.S. Pat. No. 4,894,118 discloses use of a creping angle between 60–100 degrees and 70–80 degrees but for recreped absorbent products. The Klowak U.S. Pat. Nos. 4,448,638 and 4,482,429 assigned to the Assignee herein disclose creping angles between 52°–72° using a reverse creping blade.

The Awofeso et al. U.S. Pat. Nos. 5,087,324 and 5,164,045 assigned to the Assignee herein disclose stratified paper webs having a first layer of anfractuous fiber, chemithermomechanical pulp and softwood kraft and a second layer of eucalyptus. The Spendel U.S. Pat. Nos. 4,959,125 and 4,940,513 and the Ampulski et al. U.S. Pat. No. 5,164,046 disclose methods of producing one-ply tissue paper consisting of spraying starch and surfactant on the tissue. No distinction is shown on which side the starch and surfactant are sprayed. The Ampulski patent indicates that these components are sprayed on both sides. The WO 09302252 publication discloses a method of making single-ply or double-ply tissue by spraying starch and surfactant on both sides of the web. Lim WO 82/00485 publication discloses a process for spraying an acidified debonder on the sheet while on the forming fabric before vacuum dewatering. Many studies disclose the use of debonders and softeners to improve softness. The following are representative prior art references: Freimark et al. U.S. Pat. No. 3,755,220, Aug. 28, 1973; Shaw et al. U.S. Pat. No. 3,821;068, Jun. 28, 1974; Harvey et al. U.S. Pat. No. 3,554,802, Jan. 12, 1991; Emanuelsson et al. U.S. Pat. No. 4,144,122, Mar. 13, 1979; and Becker et al. U.S. Pat. No. 4,158,594, Jan. 19, 1979. None of the foregoing prior art references relate to one-ply tissue having a low sidedness and exhibiting a sidedness parameter of less than 0.3 along with a tensile modulus of no more than 32 grams/percent strain; a GM MMD friction of no more than about 0.23; and a cross directional dry tensile strength of at least 200 grams per 3 inches.

SUMMARY OF THE INVENTION

The novel premium quality single-ply tissue having a very low "sidedness" along with excellent softness, coupled with strength is advantageously obtained by using a combination of four processing steps.

Suitably, the low sidedness bathroom tissue has been prepared by utilizing techniques falling into four categories:. (i) fiber stratification in which higher coarseness fibers are preferentially located to the Yankee side of the sheet; (ii) chemical stratification including starch and cationic softener/debonders; (iii) low angle, high adhesion creping using suitable high strength nitrogen containing organic adhesives and a crepe angle controlled to a level below 80°; and (iv) reverse embossing wherein we emboss the tissue between a hard to flexible nip (e.g. rubber-to-patterned steel), preferably with a brushed pattern, with the Yankee side of the sheet to the patterned steel roll side. The furnish advantageously is softwood or a mixture of softwood, hardwood and recycle fiber with the coarser fibers disposed on the side which comprises most of the cationic debonder or alternately the coarser fiber are deposited on the Yankee side optionally without the softener. It is preferred to emboss the tissue and more preferred to reverse emboss with the Yankee side of the sheet against the steel side of the nip. However, low sidedness of the tissue may be achieved without embossing. The premium single-ply tissue having low sidedness may be suitably obtained from a single-layer homogenous sheet, two-layer stratified sheet, or multi-layyer stratified sheet.

In our process, chemical stratification is produced by preferentially treating fibers obtained from a plurality of furnish sources with chemical moieties exhibiting different functionalities and therefore, providing different physical characteristics to the fibers originating from different sources. Suitably, the fibers from the different furnish sources may be fed separately to different plena in a stratified headbox to form a multi-layer or stratified sheet or combined upstream of a homogenous headbox to form a single-layer or homogenous tissue product. In the preferred process, the fibers are advantageously delivered in separate conduits to separate plena in a stratified headbox to form stratified two-layer or multi-layered tissue. The high degree of stratification of the two-layer but single-ply tissue is shown in the attached photograph, FIG. 21 which clearly demonstrates observable chemical stratification of fibers.

In one of our preferred novel processes utilizing chemical stratification in the two-layered sheet, we form a stratified ply wherein the Yankee side of the sheet has a relatively coarse furnish, primarily a softwood or recycle furnish. The air side has a relatively lower coarseness furnish comprising a softwood/hardwood blend or a softwood, hardwood, and recycled fiber blend in its furnish but 100% softwood is advantageously utilized. Advantageously, the air side has at least 50% softwood by weight and the rest comprises hardwood and recycle fiber. Suitably., recycled fiber comprises up to about 40% to about 60% by weight of the air side furnish. This is not an essential limitation and the recycled fiber content may vary between about 10 and 100 percent by weight depending largely upon the quality of the recycle fiber available. While starch or another strength enhancing agent may be added to both layers, the amount of starch added to the Yankee side is considerably higher than that added to the air side. Usually, starch is not deliberately added to the air side. Advantageously, the fibers from the differentiated furnish sources are delivered to separate plena of a two-layer or multi-layered headbox so that the first stratum comprises cellulosic papermaking fiber chosen from the group consisting of hardwood, softwood, and recycled fibers, and cationic nitrogenous softener/debonder, and said first stratum being disposed to contact said Yankee, the second stratum comprises cellulosic papermaking fiber chosen from the group consisting of hardwood, softwood, and recycled fibers, and cationic nitrogenous softener/debonder. Softener may be suitably added at the wet end to the air side furnish to reduce two sidedness. In some cases, it is preferred to add softener to the furnish source comprising the coarser fibers. In our preferred process, softener is applied both by spraying and by incorporation into the furnish directed to the air-side of the stratified headbox. The softener/debonder is preferably sprayed onto the Yankee side of the sheet while the sheet is on the felt after vacuum dewatering. Accordingly, it penetrates the sheet rather than remaining adjacent to the exposed surface as suggested by Soerens, U.S. Pat. No. 4,795,530 discussed above which sprays a debonder on the wet web while on the felt before vacuum dewatering. We have found that in our experience, the softener compositions described herein penetrate throughout the entirety of the depths of the sheet so that there is no substantially untreated or effectively untreated region as specified in Soerens.

Another embodiment of our process for the single-layered homogenous sheet comprises providing softwood fibers, hardwood fibers, and recycle fibers in amounts sufficient to form an overall furnish comprising from about 70% to about 10% softwood fibers by weight, about 15% to about 70% hardwood fibers by weight, and about 15% to about 75% recycled fiber by weight, by combining two separate furnishes, the first furnish comprising primarily softwood fibers and starch (as a strength enhancing agent) in the range of approximately 0.5 pounds per ton to 10 pounds per ton of overall furnish, the second furnish comprising softwood fibers, hardwood fibers, and recycle fibers, suitably, the percentage of softwood fibers by weight in said second furnish being less than the percentage of softwood fibers in said first furnish, the second furnish also comprising a quantity of cationic nitrogenous softener/debonder chosen from the group consisting of imidazolines, amido amine salts, linear amine amides, tetravalent ammonium salts and mixtures thereof in the range of about 0.5 pounds per ton to about 10 pounds per ton of overall furnish. The tissue is formed by delivering the combined furnish to a headbox of a papermaking machine forming a nascent cellulosic web from said furnish, dewatering said nascent web by overall compaction of said web, subjecting said web to low angle, high adhesion creping using a creping blade disposed at an angle of between 70° and 80°, preferably about 72° to about 78° and forming a paper product having a sidedness parameter of less than 0.3. Alternatively, cationic nitrogenous softener/debonder may also be supplied by spraying or by a combination of spraying and incorporation into the furnish.

Preferably our tissue is prepared by conventional wet pressing of a cellulosic web, adhering said web to a Yankee and creping said web from said Yankee, conducting the papermaking process so that at least two differentiated strata are formed, one having been in direct contact with the Yankee prior to creping and comprising a strength enhancing agent in a concentration substantially exceeding the concentration of said strength enhancing agent in the other stratum of the single-ply tissue product.

Our preferred process comprises providing softwood fibers, hardwood fibers, and recycle fibers in amounts sufficient to form an overall furnish comprising from about 100° to about 50% softwood fibers by weight, about 40% to about 20% hardwood fibers by weight, and about 40% to about 15% recycle fiber by weight. Our process comprises forming a first furnish comprising primarily softwood fibers in a first machine chest; forming a second furnish comprising hardwood fibers, recycle fibers, and softwood fibers in a second machine chest, the percentage of softwood fibers by weight in said second furnish being less than the percentage of softwood fibers in said first furnish; though 100% softwood in the second furnish is suitable and the process further comprises supplying a predetermined quantity of starch in the range of approximately 0.5 pounds per ton to 10 pounds per ton of overall furnish to said first furnish; supplying a predetermined quantity of cationic nitrogenous softener/debonder chosen from the group consisting of imidazolines, amido amine salts, linear amine amides, tetravalent ammonium salts, and mixtures thereof in the range of 0.5 pounds per ton to 10 pounds per ton to said second furnish; providing a stratified headbox having a plurality of plena; delivering said first furnish with said starch to one plenum of said stratified headbox; delivering said second furnish with said cationic nitrogenous softener debonder to second plenum of said stratified headbox; and forming a paper product having a low sidedness and having a sidedness parameter of less than 0.3.

In our process, refined furnishes are also suitable. In many cases, strength enhancing agents may be omitted or used in reduced quantities provided the Canadian Standard Freeness (CSF) of at least a major portion of the softwood fibers incorporated into the first furnish source is about 50 points less than the CSF of the fiber incorporated in the second furnish source, i.e., the Yankee side furnish is more highly refined. Suitably, a first stratum comprises cellulosic papermaking fiber chosen from the group consisting of hardwood, softwood, refined softwood and recycled fibers, and cationic nitrogenous softener/debonder, along with strength enhancing agents, at least a major portion of said softwood fiber in said first stratum having been refined, said first stratum having been in contact with the Yankee.

The second stratum comprises cellulosic papermaking fiber chosen from the group consisting of hardwood, softwood, and recycled fibers, cationic nitrogenous softener/debonder, and optionally, strength enhancing agent; The operating definition of CSF is given in the textbook by James d' A. Clark entitled, *Pulp Technology and Treatment for Paper*, Miller Freeman Publication Inc., San Francisco, Calif., 1978.

To quantify the degree of sidedness of a single-ply tissue we use a quantity which we term sidedness parameter or S. We define sidedness parameter S as $$S = 1/2 \frac{[GM\ MMD]_A}{[GM\ MMD]_Y} \{[GM\ MMD]_A + [GM\ MMD]_Y\}$$

where $[GM\ MMD]_A$ and $[GM\ MMD]_Y$ are respectively air and Yankee side geometric mean friction deviations or overall surface friction. S takes into account not only the relative difference between air and Yankee side friction but also the overall friction level. Accordingly, low S values are preferred. S values of 0.1–0.3 indicate that the tissue has low sidedness. Preferably, the sidedness parameter is about 0.15 to about 0.225.

Similarly, since we prefer to use high adhesion creping, to quantify the degree of adhesion, we define adhesion as the force in grams required to peel a 12 inch wide sheet off the creping cylinder at a 90 degree angle with the creping doctor in the off-load position. We have found that using a known creping adhesive, comprising a polyacrylamide (PA), preferably glyoxylated, it is possible to control adhesion such that the junction between the sheet and Yankee exhibits relatively high adhesion compared to conventional adhesives which include polyaminoamides-epichlorohydrin (PAE) and polyvinyl alcohol resins. High adhesion level is preserved when PA is used as the creping adhesive even in the presence of softener and debonder so low sidedness can be better controlled and maintained when softener is used. Specifically, when softener is used in the range of 1–4 pounds per ton, PA adhesion is good as defined by the peel force of about 300 to about 900 grams per 12 inches, and corresponding S value is below 0.3. Generally, when softener is added, adhesion is decreased and the sidedness parameter S is increased. Surprisingly, when utilizing PA adhesives, they do not lose adhesive capacity in the presence of softeners and the S values remain low. Unlike conventional adhesives of the PAE type and the like, utilization of PA in conjunction with softener, allows one to minimize the difference between air and Yankee side friction while preserving overall low friction, all of which promote high quality crepe structure required for good tissue softness and reduced sidedness.

We have also produced from a single-layered sheet a soft bathroom tissue product having a low sidedness comprising a roll of single-ply tissue formed by conventional wet pressing of a cellulosic web, adhering said web to a Yankee and creping said web from said Yankee said tissue being formed from at least two furnish sources. The furnish sources may either have been combined prior to depositing furnish on forming fabric or alternately may have been fed separately. The first furnish source comprises a strength enhancing agent such as water soluble starch having an amylose and amylopectin content of about 1 to about 30 and about 99 to about 70 percent, respectively. It should be noted that when starch is added under our process conditions it functions not only to enhance strength of the tissue but also aids in creping while exhibiting advantageous adhesive properties. The second furnish source comprises cationic softener/debonder and may suitably contain starch but, preferably, the starch level in the air-side layer is kept at as low a level as is convenient and no starch is deliberately added to the air side of the sheet. The amount of softener/debonder added is advantageously about 0.5 pounds to about 12 pounds for each ton of furnish. Preferably about 2 pounds to about 6 pounds for each ton of furnish. The softener/debonder is chosen from the group consisting of imidazolines, amido amine salts, linear amido amines, tetravalent ammonium salts, and mixtures thereof. In our process, the softeners/debonders are thought to enhance flexibility by reducing hydrogen bonding and imparting lubricity to the fibers through the fatty acid components. This lubricity translates into consumer sensory softness and related advantageous features set forth in FIGS. 3 to 8. The flexibility and lubricity combine to give an excellent hand feel and results in a low sidedness for our tissue.

One of the papermaking parameters that has a significant effect on tissue properties, especially softness, is creping angle. For two-ply tissue products, it has been shown that a creping angle in the range of 80 to 90 degrees is preferred to maximize the softness of the tissue's Yankee side. As the Yankee side of the tissue is the only side that is touched by the consumer, the effect of the creping angle on the base sheet's air side is not considered. For one-ply products, on the other hand, attention must be paid to the softness of both sides of the sheet as both will be in contact with the user. Creping angles that maximize the softness of one side of the sheet at the expense of the other are not suitable for a one-ply product. For one-ply products, therefore, it is necessary for both sides of the tissue sheet to have similar softness levels. We have discovered that when tissue is creped off of the Yankee, the "creping angle", the acute included angle between the Yankee and the blade should be between 70° and 80°, preferably in the range of about 72° to about 78°, as when creping angles in this range are used, the sidedness of the tissue sheet is greatly reduced. This is an unexpected finding.

To further enhance the softness and minimize the sidedness in the novel process, we use a reverse embossing procedure in which the patterned roll or the harder roll of the embossing nip engages the Yankee side of the sheet, while the softer roll in the nip engages the air side of the sheet. We have found that by brushing the caps of the steel roll bearing our emboss pattern, friction, modulus and sidedness can be improved.

The most common prior art one-ply CWP processes use embossing processes wherein the pattern roll is against air side of the sheet. These are normally preferred for reducing sidedness. While tissue products with low sidedness can be obtained when the embossing pattern roll is against the air side of the sheet, sidedness can usually be reduced by reverse embossing with the Yankee side against the patterned roll. Advantageously, the pattern roll is a steel roll and the softer roll is a rubber roll.

Esthetics and tactile considerations are extremely important for tissue products as they often come into intimate contact with the most delicate parts of the body in use. Consequently, demand is quite high for products with improved tactile qualities, particularly softness. However, as tissue products are frequently used to avoid contact with that which the consumer would greatly prefer not to touch, softness alone is not sufficient; strength is also required. Merely providing a product with improved properties is not generally sufficient, the "on the shelf" appearance of the product must suggest both strength and softness while consumers must be able to sense improvements by handling packaged product. Appearance is critical; bulk, weight, compressibility, firmness, texture and other qualities perceived as indicia of strength and softness are also required.

It has been shown that the surface softness of a tissue is negatively correlated to the geometric mean friction deviation, or GM MMD value measured using a Kawabata friction tester Model SE. In other words, this correlation demonstrates that as a surface friction increases, overall surface softness is decreased. If overall softness is decreased, additional sidedness is introduced since the decrease is not uniform on both sides. Of course, if there are very high friction values on one side, the product does not meet the parameter of our novel tissue and may have to be sold at a great discount or be discarded. By comparing the GM MMD values for the two sides of a one-ply tissue, the two sidedness of a product may be determined as set forth above. Tissues exhibiting low tensile moduli and having low friction deviation values on both sides and having a low delta between these values characterize our preferred tissues.

In summary, we have discovered a novel process for the manufacture of an improved soft single-ply tissue having very low sidedness. Our most preferred embodiment of the novel process comprises using In the tissue manufacturing process a combination of: (i) fiber stratification, (ii) chemical stratification, (iii) low angle, high adhesion creping using a crepe angle of between about 70° and about 80° and an adhesive package that provides high adhesion as measured by peel force, and (iv) reverse embossing, these processes being combined as taught herein to obtain a very low sidedness parameter. We preferably emboss the tissue with the pattern roll of the embossing nip engaging the Yankee side of the sheet, but the effect of this seems to be rather less, so it is quite feasible to emboss with the steel against either side and still obtain low-sidedness products. In the novel process combinations incorporating some or all of the steps as set forth above are selected to produce a soft tissue having a sidedness parameter of less than 0.3; a GM MMD of less than about 0.23; and a tensile modulus of less than 32 grams/percent strain. Preferably, the tissue exhibits a sidedness parameter of less than 0.225; a tensile modulus of no more than 27 grams/percent strain; a GM MMD friction of no more than about 0.21.

Further scope of applicability of the present invention will become apparent from the detailed description given hereinafter. However, it should be understood that the detailed description and specific examples, while indicating preferred embodiments of the invention, are given by way of illustration only, since the essence of the invention is to combine and manipulate the processes described above in such a way as to obtain a low-sidedness tissue having the claimed properties. Accordingly, various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus, are not limitative of the present invention, and wherein:

FIG. 9 demonstrates the efficiency of using high adherence coating adhesives to reduce sidedness parameter at different levels of softener addition.

FIGS. 21 and 21A are photographs showing the high degree of chemical and fiber stratification of the tissue of the present invention and another otherwise identical product which is not chemically stratified and is used as a control.

DETAILED DESCRIPTION OF THE INVENTION

In accordance with the present invention, a method is provided for producing a highly absorbent, predominantly one-ply cellulosic tissue that exhibits excellent overall quality and a high degree of surface-perceived softness and very low sidedness. For the sake of simplicity, the invention will be described immediately hereinbelow in the context of a conventional dry crepe wet-forming process. A schematic drawing depicting a process configuration is set forth in FIG. 1.

Figure 1:
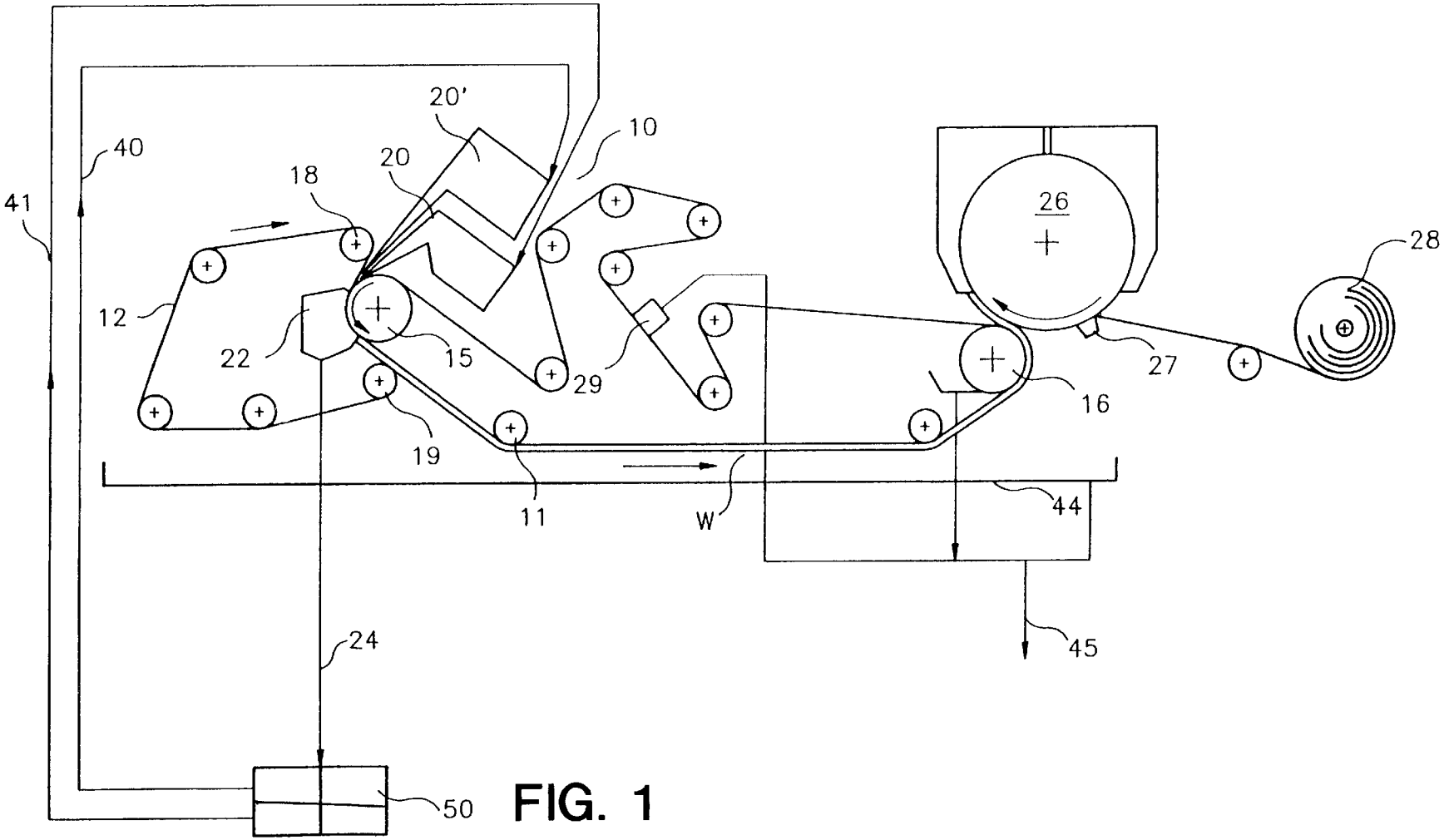
FIG. 1 is a schematic flow diagram of a paper machine having a stratified headbox showing potential points and conduits for preferentially treating furnish sources with chemicals and delivering chemically treated furnishes to the paper machine.

Tissue products of the present invention may be manufactured on any papermaking machine of conventional forming configurations such as fourdrinier, twin-wire, suction breast roll or crescent forming configurations. The forming mode is advantageously water or foam. FIG. 1 illustrates an embodiment of the present invention wherein a compartmentalized machine chest 50 is used for preparing furnishes that are preferentially treated with chemicals having different functionality depending on the character of the various fibers particularly fiber length and coarseness. The differentially treated furnishes are transported through different conduits, 40 and 41, where the furnishes are delivered to the headbox of a crescent forming machine 10. Suitably, the furnish transported by conduit 40 may contain relatively long or coarse fiber along with strength enhancing agent while 41 may contain a lower coarseness furnish along with softener. This FIG. 1 and also FIG. 2 include a web-forming end or wet end with a liquid permeable foraminous support member 11 which may be of any conventional configuration. Foraminous support member 11 may be constructed of any of several known materials including photo polymer fabric, felt, fabric or a synthetic filament woven mesh base with a very fine synthetic fiber batt attached to the mesh base. The foraminous support member 11 is supported in a conventional manner on rolls, including breast roll 15 and couch roll or pressing roll 16.

Forming fabric 12 is supported on rolls 18 and 19 which are positioned relative to the breast roll 15 for pressing the press wire 12 to converge on the foraminous support member 11 at the cylindrical breast roll 15 at an acute angle relative to the foraminous support member 11. The foraminous support member 11 and the wire 12 move in the same direction and at the same speed which is the same direction of rotation of the breast roll 15. The pressing wire 12 and the foraminous support member 11 converge at an upper surface of the forming roll 15 to form a wedge-shaped space or nip into which two jets of water or foamed-liquid fiber dispersion is pressed between the pressing wire 12 and the foraminous support member 11 to force fluid through the wire 12 into a saveall 22 where it is collected for reuse in the process.

A wet nascent web W formed in the process is carried by the foraminous support member 11 to the pressing roll 16 where the wet nascent web W is transferred to the drum 26 of a Yankee dryer. Fluid is pressed from the wet web W by pressing roll 16 as the web is transferred to the drum 26 of the Yankee dryer where it is dried and creped by means of a creping blade 27. The finished web is collected on a take-up roll 28.

A pit 44 is provided for collecting water squeezed from the furnish by the press roll 16 and a Uhle box 29. The water collected in the pit 44 may be collected into a flow line 45 for separate processing to remove surfactant and fibers from the water and to permit recycling of the water back to the papermaking machine 10. The liquid, suitably foamed liquid, is collected from the furnish in the saveall 22 and is returned through line 24 to a recycle process generally indicated by box 50.

Figure 2:
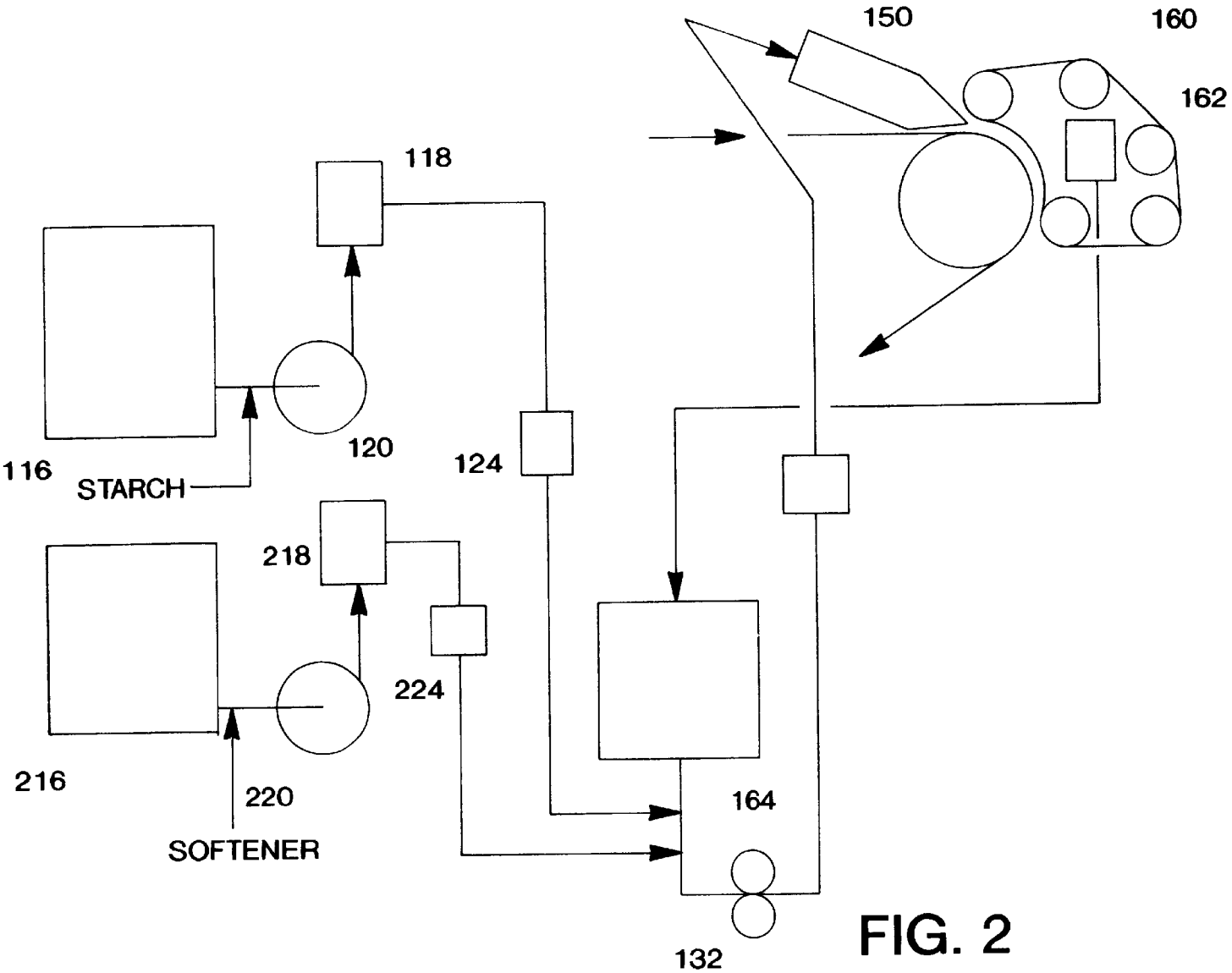
FIG. 2 is a schematic flow diagram of a furnish supply for a papermaking machine having a homogenous (non-stratified) headbox and two machine chests showing the potential points to the addition of a starch and a softener debonder.

FIG. 2 illustrates another embodiment of the present invention wherein two machine chests are used for preparing the furnish. First machine chest 116 is provided for processing one furnish source. First machine chest pump 120 pumps the furnish from first machine chest 116 to first stuff box 118. Flow meter 124 is provided for detecting the basis weight of the furnish as the furnish is supplied to fan pump 132 for delivery to headbox 150. Headbox 150 supplies the furnish to crescent former papermaking machine 160. Saveall 162 is provided for returning furnish supplied to the wire of crescent former papermaking machine 160 back to fan pump silo 164 for subsequent supply to fan pump 132.

Second machine chest 216 is provided for processing the second furnish source. Second machine chest pump 220 pumps the furnish from second machine chest 216 to second stuff box 218. Flow meter 224 is provided for detecting the basis weight of the furnish as the furnish is supplied to fan pump 132 for delivery to headbox 150.

Starch is added as a strength enhancing agent to the first furnish source when necessary after the furnish is prepared in the first machine chest 116. By allowing the cellulose fibers in the furnish to react with the starch, or any other strength enhancing agent, the overall strength can be brought into the desired range. We prefer to contact the starch primarily with the fibers in the first furnish source and fibers in the second furnish source may be contacted primarily with the cationic nitrogenous softener/debonder. Suitably, this order is reversed for special applications.

Headbox 150 supplies furnish to crescent former papermaking machine 160. Headbox 150 may be either homogenous or stratified with separate supplies of furnish for making a stratified layered tissue on crescent former 160.

In the process of the present invention, an aqueous furnish including cellulose papermaking fibers is initially formed. The cellulosic fibers have undergone some degree of lignin modification, such as at least partial chemical treatment, to produce materials such as chemimechanical pulp, semichemical pulp, chemical pulp, or mixtures thereof. Suitable materials from which the cellulose fibers can be derived include the usual species of coniferous and deciduous pulpwood. Conventional pulping processes may be used including kraft, sulfite, chemithermomechanical (CTMP), soda, neutral sulfite semichemical (NSSC), TMP and related processes.

The aqueous furnish is transported to a headbox 150. The headbox 150 can be any type suitable for conventional wet-forming. Multi-layer headboxes are often used in the preparation of bathroom tissue, with three or four layer headboxes being particularly useful in the preparation of one-ply bathroom tissue. A conventional pulp refiner system may also be present upstream of the headbox. As a practical matter, the consistency of the aqueous furnish used in forming the subject wet web is desirably maintained at a level of from about 0.05% by weight up to about 1.0% by weight, and more preferably from about 0.1% by weight up to about 0.75% by weight, based on the total weight of cellulosic papermaking fibers in the aqueous furnish.

Nitrogenous softener/debonders and adhesives are added in the tissue manufacturing process. The softener may be suitable when added with the furnish or also sprayed to the sheet while the sheet is on the Yankee. The adhesive is advantageously sprayed on the Yankee metal.

Representative softeners have the following structure:

$$[(RCO)_2EDA]HX$$

wherein EDA is a diethylenetriamine residue, R is the residue of a fatty acid having from 12 to 22 carbon atoms, and X is an anion or $$[(RCONHCH_2CH_2)_2NR']HX$$

wherein R is the residue of a fatty acid having from 12 to 22 carbon atoms, R' is a lower alkyl group, and X is an anion.

The preferred softener is Quasoft® 202-JR and 209-JR made by Quaker Chemical Corporation which is a mixture of linear amine amides and imidazolines of the following structure:

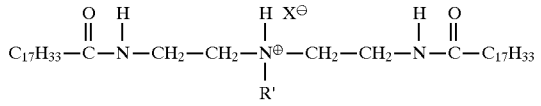

(i)

and

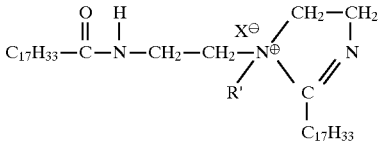

(ii)

wherein X is an anion.

As the nitrogenous cationic softener/debonder reacts with a paper product during formation, the softener/debonder ionically attaches to cellulose and reduces the number of sites available for hydrogen bonding thereby decreasing the extent of fiber-to-fiber bonding.

The present invention may be used with a particular class of softener materials—amido amine salts derived from partially acid neutralized amines. Such materials are disclosed in U.S. Pat. No. 4,720,383; column 3, lines 40–41. Also relevant are the following articles: Evans, *Chemistry and Industry*, 5 Jul. 1969, pp. 893–903; Egan, *J. Am. Oil Chemist's Soc.*, Vol. 55 (1978), pp. 118–121; and Trivedi et al., *J. Am. Oil Chemist's Soc.*, June 1981, pp. 754–756. All of the above are incorporated herein by reference. As indicated therein, softeners are often available commercially only as complex mixtures rather than as single compounds. While this discussion will focus on the predominant species, it should be understood that commercially available mixtures would generally be used to practice.

At this time, Quasoft® 202-JR and 209-JR is a preferred softener material which is derived by alkylating a condensation product of oleic acid and diethylenetriamine.

Synthesis conditions using a deficiency of alkylating agent (e.g., diethyl sulfate) and only one alkylating step, followed by pH adjustment to protonate the non-ethylated species, result in a mixture consisting of cationic ethylated and cationic non-ethylated species. A minor proportion (e.g., about 10%) of the resulting amido amines cyclize to imidazoline compounds. Since these materials are not quaternary ammonium compounds, they are pH-sensitive. Therefore, in the practice of the present invention with this class of chemicals, the pH in the headbox should be approximately 6 to 8, more preferably 6 to 7 and most preferably 6.5 to 7.

The softener employed for treatment of the furnish is provided at a treatment level that is sufficient to impart a perceptible degree of softness to the paper product but less than an amount that would cause significant runnability and sheet strength problems in the final commercial product. The amount of softener employed, on a 100% active bases, is preferably from about 1.0 pounds per ton of furnish up to about 10 pounds per ton of furnish. More preferred is from about 2 to about 5 pounds per ton of furnish.

Treatment of the wet web with the softener can be accomplished by various means. For instance, the treatment step can comprise spraying, applying with a direct contact applicator means, or by employing an applicator felt.

In a suitable process, the wet web which has been dewatered to the point where from 50 to 85% moisture, preferably from 60 to 75% moisture, remains therein, is carried by the felt resting on rolls such as suction press roll. The softener may suitably be applied to this partially moist web at this stage by intensive spray just before significant drying energy is imparted on the sheet.

The softener material is pumped into a mixing tank wherein it is combined with the correct proportion of water by means of metering pumps. For a typical operation, the percentage of softener in the water in the mixing tank may vary from 0.5% to about 15% by weight. Most of the softener compounds mix fairly easily with water, although special prolonged agitation may be necessary under certain circumstances.

From the mixing tank the aqueous solution may be passed through a spray pump into a filter for removal of any impurities. This filter may be of the full or continuous flow type. After the filter, the solution goes into a feed tank, and from the feed tank into the spray head.

The spray head applies the solution, generally in the form of a very fine mist, to the partially dried formed tissue. Material that is not absorbed by the tissue may be caught within a catch pan and is recovered into a recovery tank from which it returns through a filter into the mixing tank. If sufficient control is exercised over the amount of active solution sprayed onto the web adhered to the Yankee, there will be no significant runoff and a catch pan may not be necessary.

The adhesive is added directly to the metal of the Yankee, and advantageously, it is sprayed directly on the surface of the Yankee dryer drum. The suitable nitrogen containing adhesives such as glyoxylated polyacrylamide, and polyaminoamides. Blends such as the glyoxylated polyacrylamide blend comprise at least of 40 weight percent polyacrylamide and at least 4 weight percent of glyoxal. Polydiallyldimethyl ammonium chloride is not needed for use as an adhesive but it is found in commercial products and is not detrimental to our operations.

The preferred blends comprise about 2 to about 50 weight percent of the glyoxylated polyacrylamide, about 40 to about 95 percent of polyacrylamide. Preferred glyoxylated polyacrylamides are manufactured by Nalco and have the following structure:

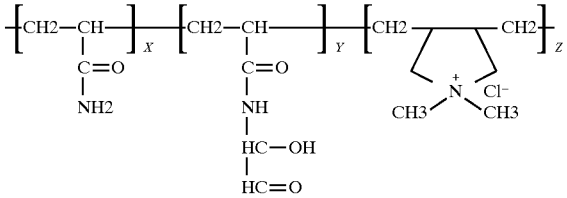

In the foregoing formula X, Y, and Z are whole numbers between 1 and 100. Suitable values of X and Y are the same or different. The value of Z may suitably be 0 but values of 1–10 are acceptable. As stated hereinabove the Z moieties do not significantly enhance the adhesive properties of the terpolymers or blends but are found in commercial products.

Figure 9:
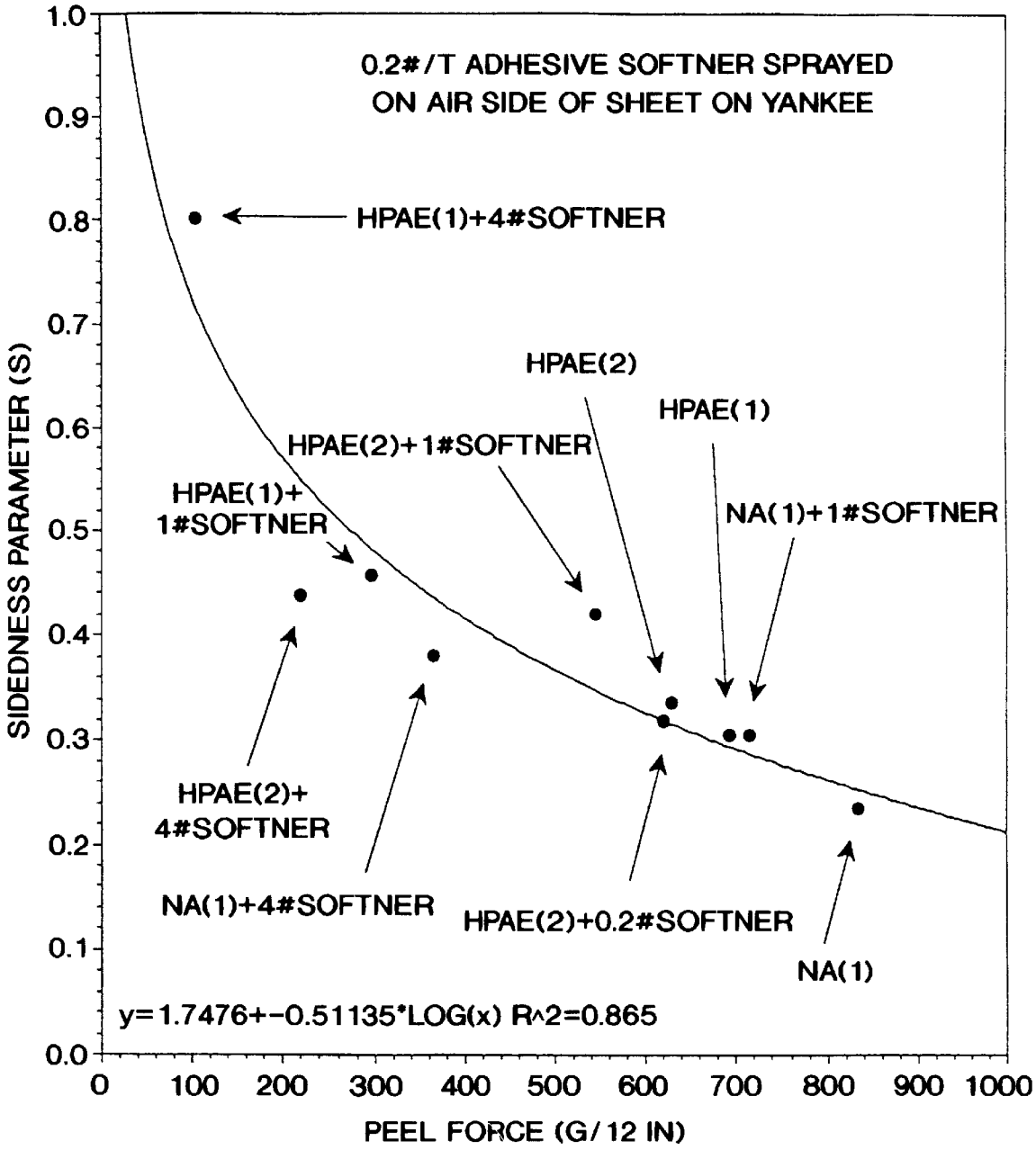
FIG. 9 is a graph illustrating the relationship of peel force to sidedness.
Figure 10:
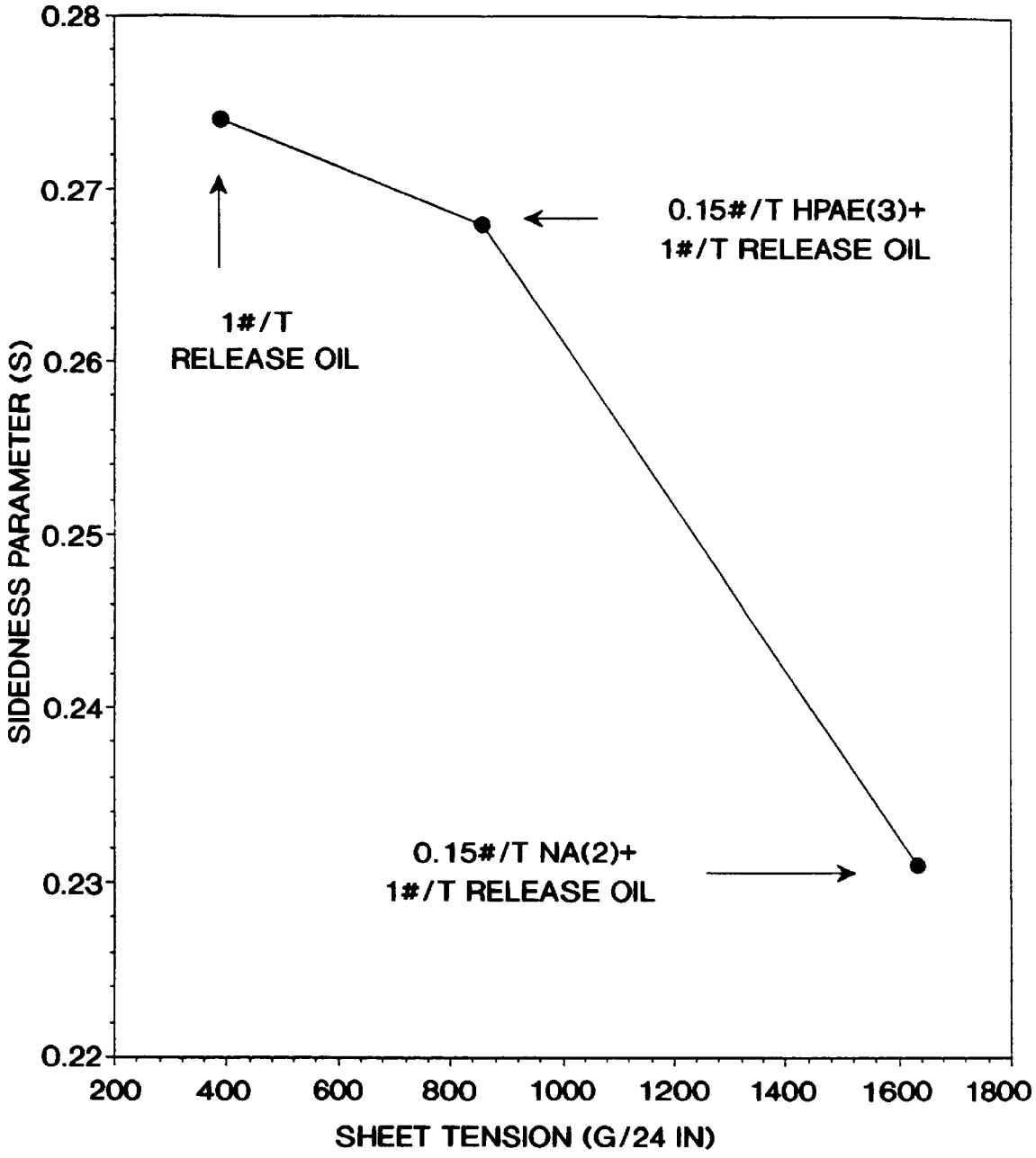
FIG. 10 is a graph illustrating the relationship of sidedness to creping adhesive adhesion between Yankee and sheet as measured by sheet tension. At sheet tension of about 1700 g/24", the sidedness parameter of 0.23 is obtained, while at a sheet tension of 400, the sidedness increases to 0.275.
Figure 11:
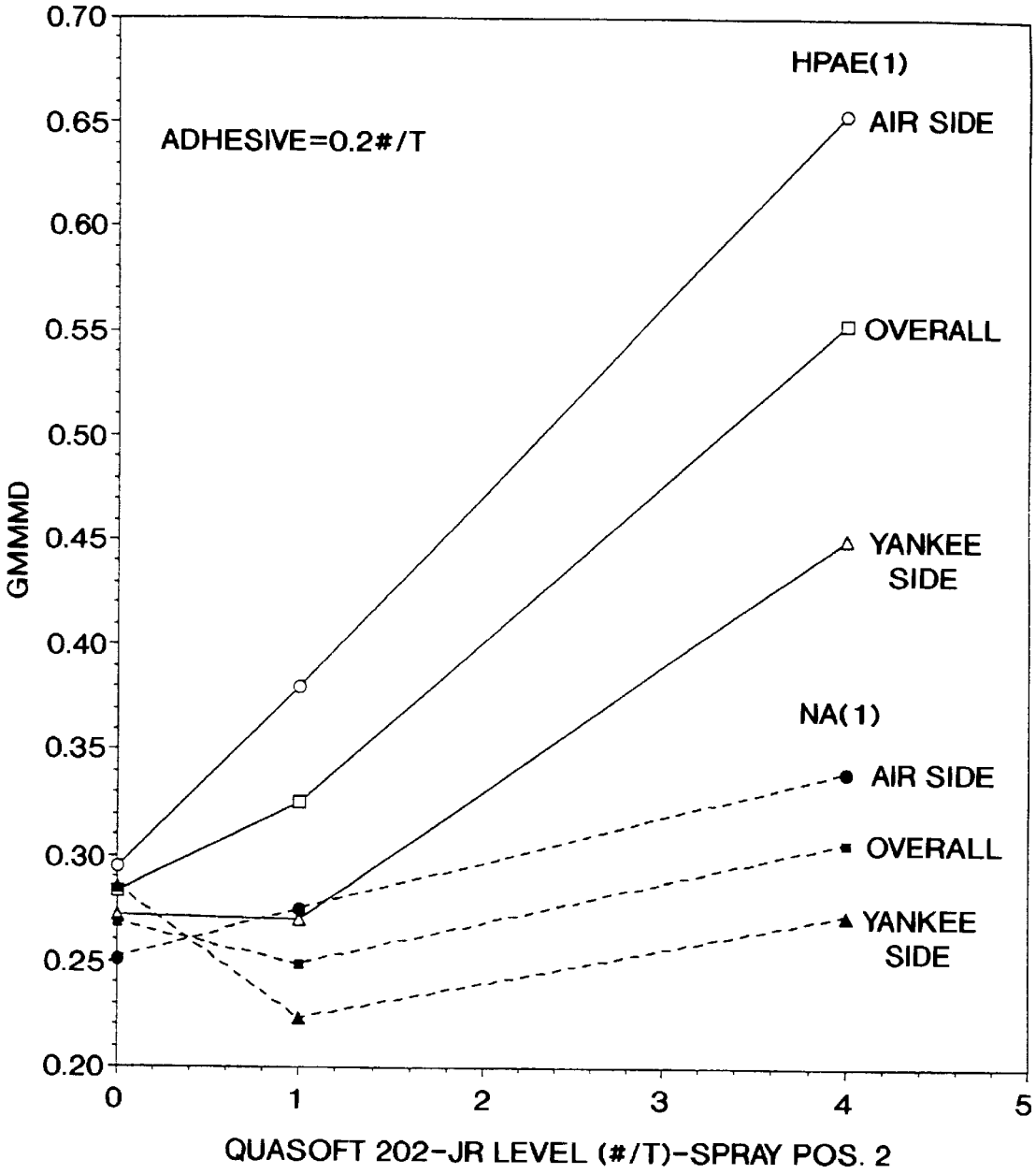
FIG. 11 is a graph which demonstrates that glyoxylated polyacrylamide (NALCO) is the preferred adhesive, even in the presence of softeners as it helps to maintain the high levels of adhesion preferred for the practice of the present invention. When the polyacrylamide additive is present, the GM MMD (friction) had a value of less than 0.30 while the comparable value for the polyaminoamides-epichlorohydrin was 0.55.
Figure 12:
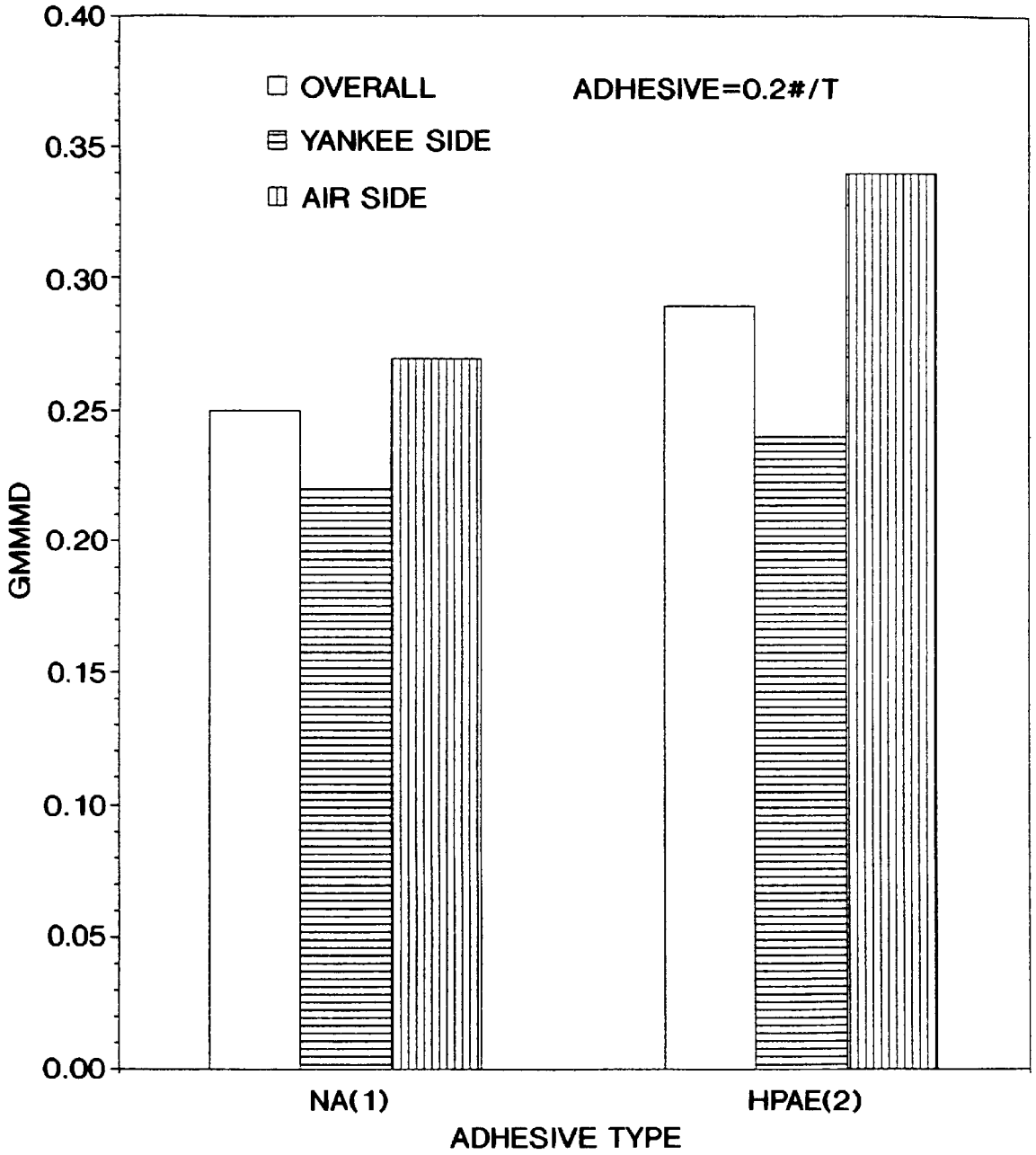
FIG. 12 is a graph illustrating that the difference in friction between the Yankee and the air side are the lowest with high adherence creping adhesives comprising glyoxylated polyacrylamide.

Suitable polyaminoamide resins have the following structure:

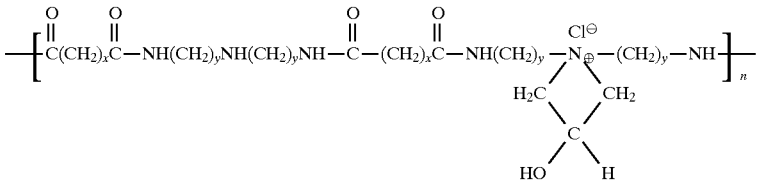

wherein X and Y have the same or different values from about 1 to 6. The preferred values are Y=2 and X=4. The value of n is not critical since this is a thermo-setting polymer and the molecular weight increases by cross-linking when the polymer moiety comes in contact with the Yankee. The preparation of the polyaminoamide resins is disclosed in U.S. Pat. No. 3,761,354 which is incorporated herein by reference. The preparation of polyacrylamide adhesives is disclosed in U.S. Pat. No. 4,217,425 which is incorporated herein by reference. FIGS. 9, 10, and 11 demonstrate that the use of polyacrylamide adhesives improves the sidedness parameter of the novel tissue and therefore, are the preferred adhesives. The data also shows that a sidedness parameter below 0.3 is suitably obtained when using polyaminoamide adhesive.

The tissue products prepared according to the process of this invention exhibit excellent surface friction properties and a low tensile modulus. As demonstrated in FIG. 3, all our tissue products have a surface friction below 0.2 and a tensile modulus below 20. Commercial tissue prepared utilizing conventional CWP and TAD processes may have values reaching a tensile modulus of about 70 and surface friction in excess of about 0.26. A product having those properties tends to exhibit high sidedness, harsh texture and low consumer acceptance.

FIGS. 3 to 8 demonstrate superior properties of the one-ply low sidedness tissues. In all the figures suitable, low sidedness, softness, and strength properties are highlighted by a box in the graph. Suitably, products within the parameters of the box meet the novel one-ply tissue physical property parameters. All the graphs as well as examples utilize the Monadic Home Use test. Appropriate sources to these tests are referred to in Example 1. The commercial products set forth in the figures are identified as follows. Our products have the same code as they have in the examples.

TABLE I

CODE KEY

| PLY | CODE | PROCESS UTILIZED | REMARKS |
|---|---|---|---|
| 2-Ply | U | TAD | Commercial |
| 2-Ply | Q | CWP | Commercial |
| 2-Ply | M | CWP | Commercial |
| 2-Ply | SP | CWP | Commercial |
| 1-Ply | C | TAD | Commercial |
| 1-Ply | K | TAD | Commercial |
| 1-Ply | N | TAD | Commercial |
| 1-Ply | J | CWP | Commercial |
| 1-Ply | S | CWP | Commercial |
| 1-Ply | W4T | CWP | Present Invention |
| 1-Ply | W3T | CWP | Present Invention |
| 1-Ply | P33T | CWP | Present Invention |

Figure 3:
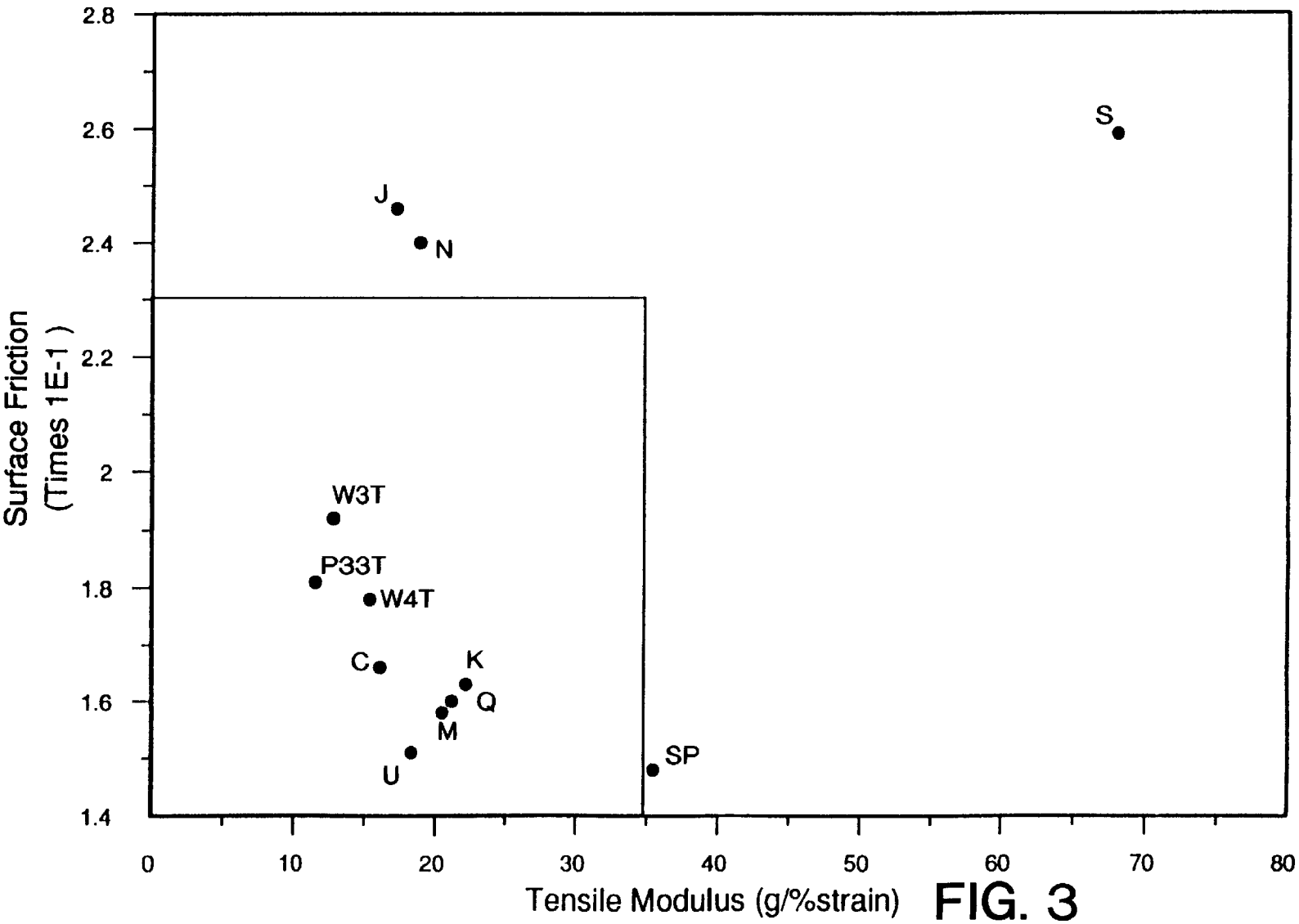
FIG. 3 is a graph illustrating the tensile modulus and surface friction for three tissue samples (W4T, W3T, and P33T) of the present invention, as compared to commercially available CWP and TAD bathroom products.
Figure 4:
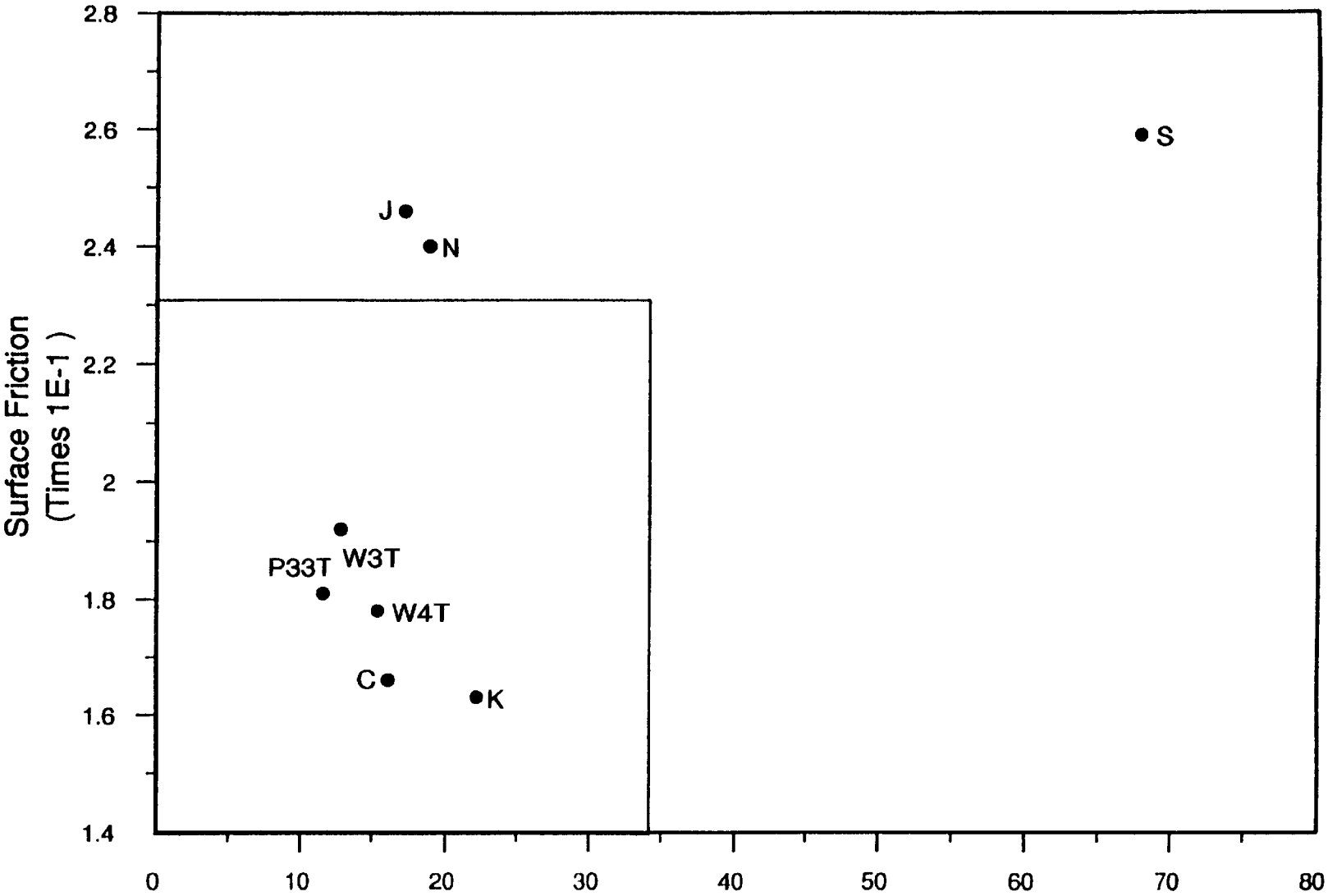
FIG. 4 is a graph illustrating the tensile modulus and surface friction for three tissue samples (W4T, W3T, and P33T) of the present invention, as compared to commercially available one-ply CWP and one-ply TAD bathroom products.

FIG. 3 shows the data for commercial products including premium two-ply and one-ply products. While FIG. 4 indicates only our novel tissue and commercial one-ply products, both figures demonstrate that the claimed tissue has superior properties to one-ply CWP products available on the market.

Figure 5:
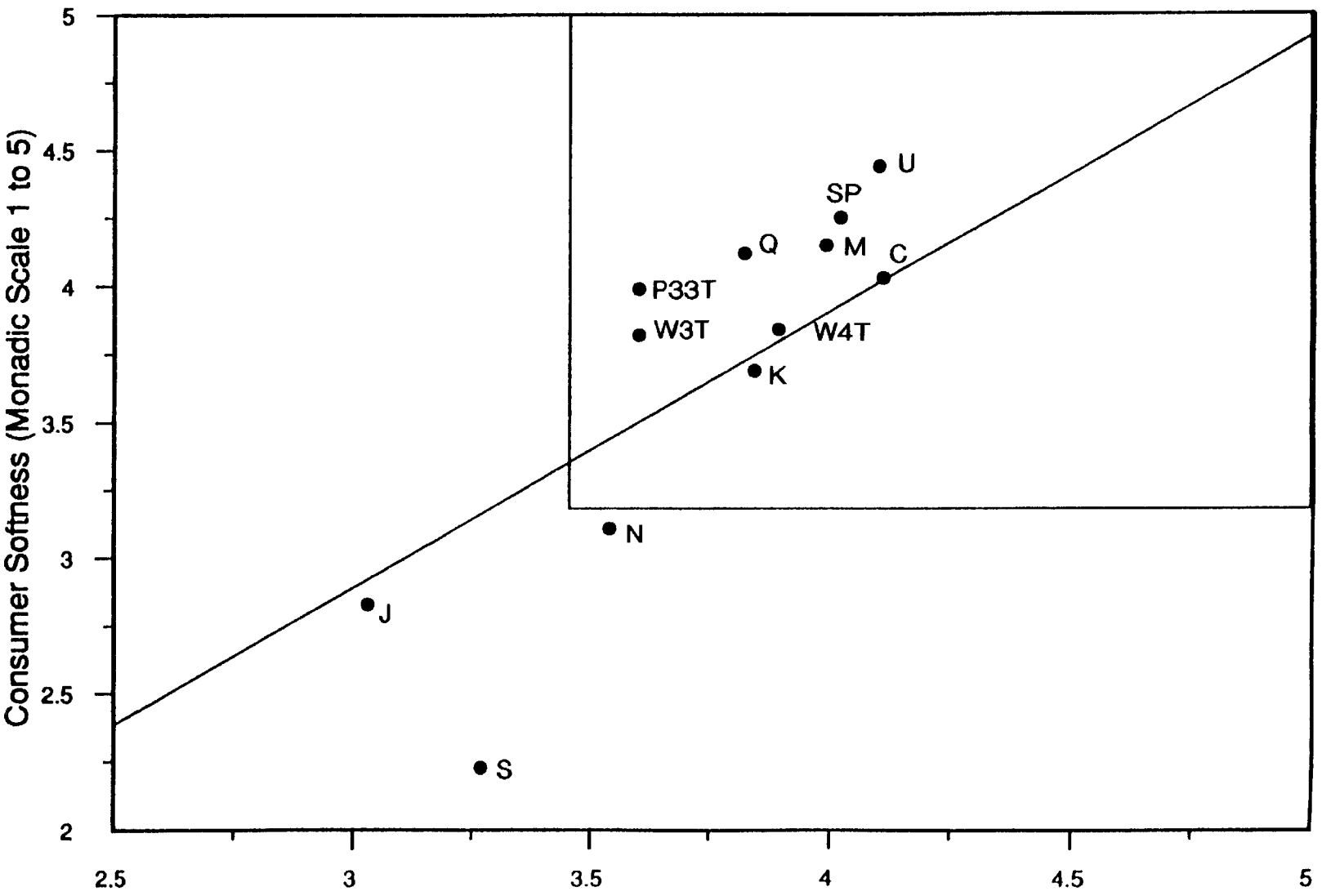
FIG. 5 is a graph illustrating perceived consumer softness and strength for three tissue samples (W4T, W3T, and P33T) of the present invention, as compared to commercially available CWP and TAD bathroom products.
Figure 6:
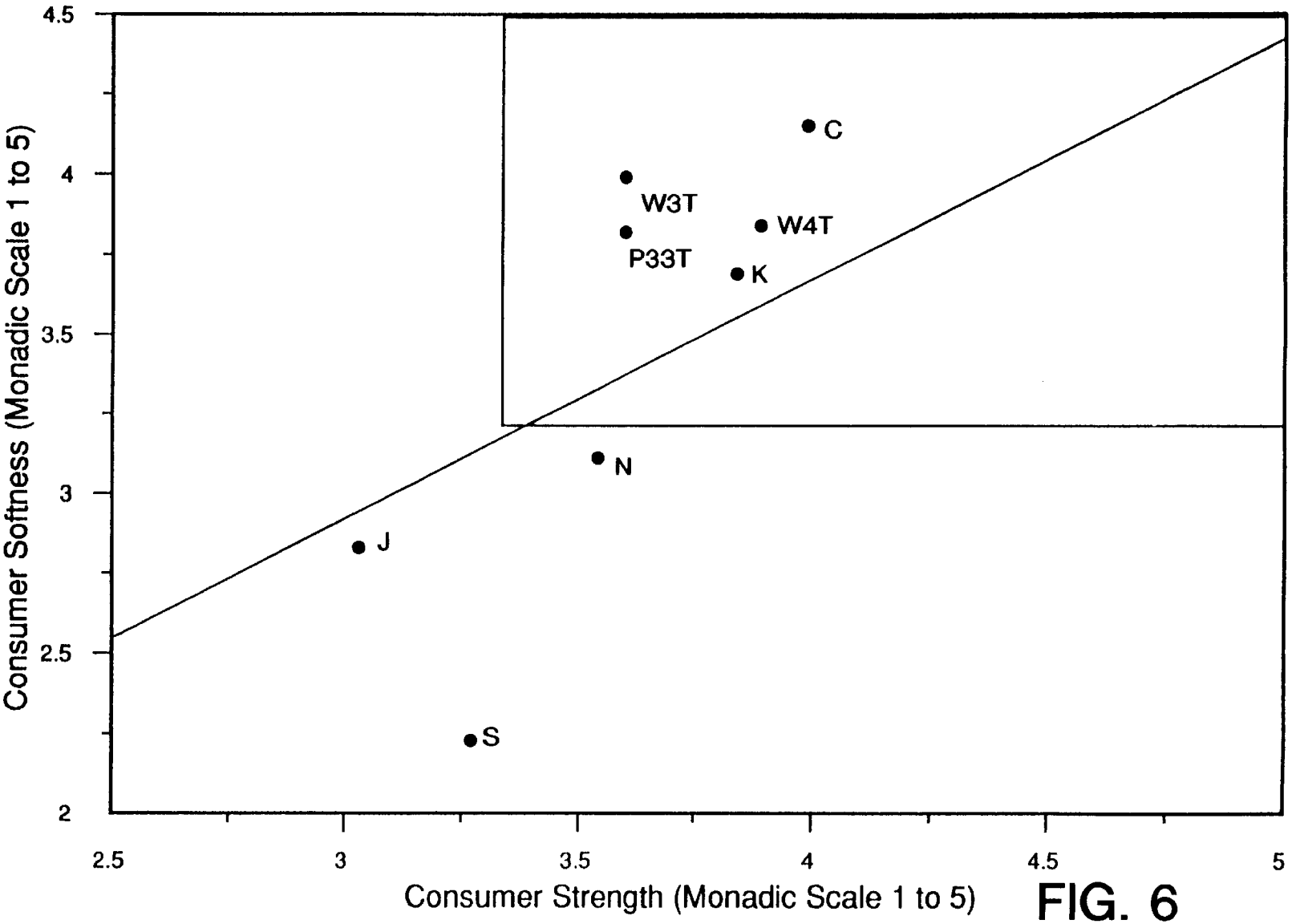
FIG. 6 is a graph illustrating perceived consumer softness and strength for three tissue samples (W4T, W3T, and P33T) of the present invention; as compared to commercially available one-ply CWP and TAD bathroom products.

FIGS. 5 and 6 demonstrate that the novel one-ply tissue exhibits a perceived consumer strength of better than 3.6 and a consumer perceived softness of better than 3.5. This places the novel one-ply tissue in the company of premium two-ply or TAD produced one-ply tissue. The poor consumer softness and consumer strength values are shown for one-ply commercial products.

Figure 7:
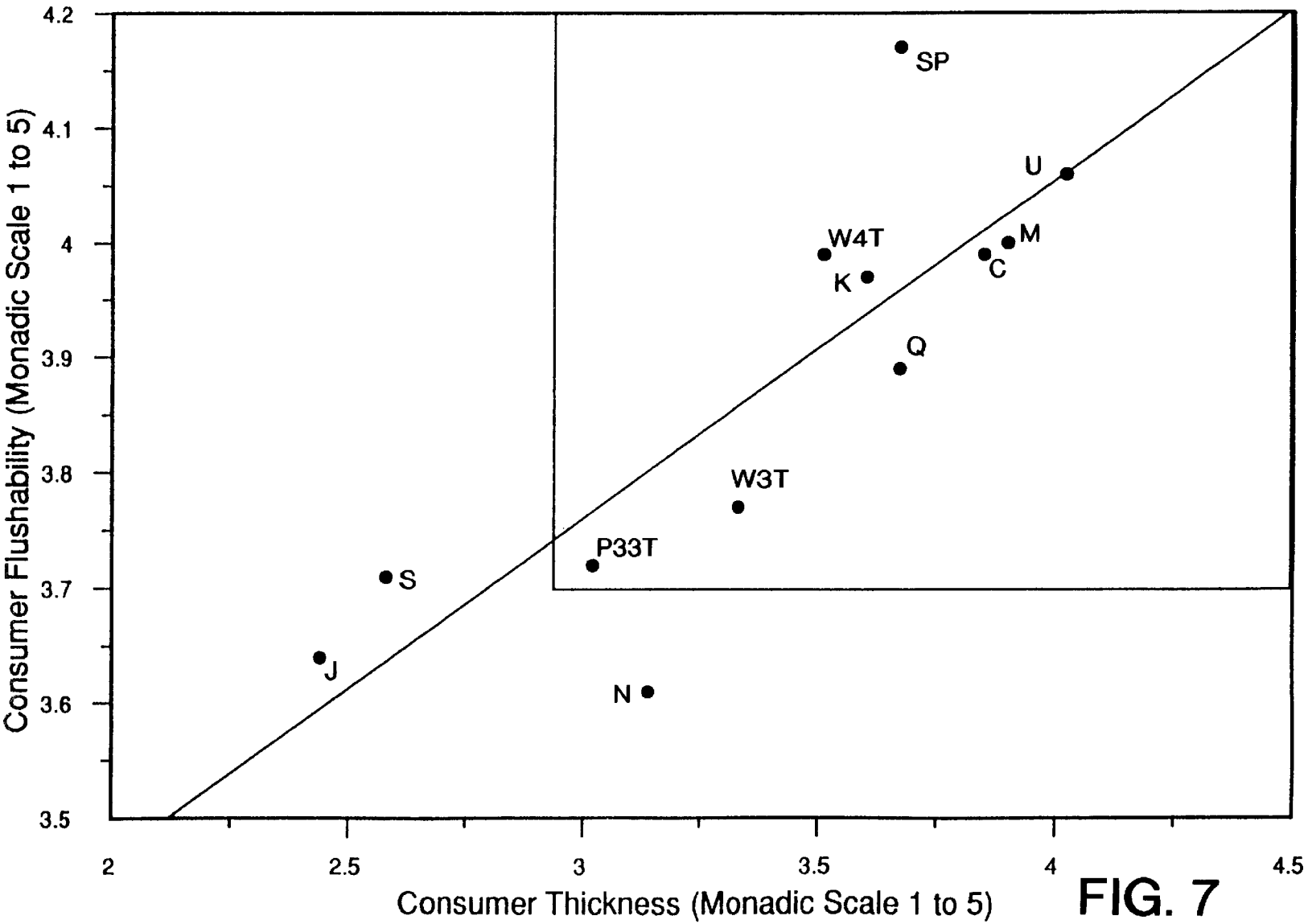
FIG. 7 is a graph illustrating the consumer flushability and thickness for three tissue samples (W4T, W3T, and P33T) of the present invention, as compared to commercially available CWP and TAD bathroom products.
Figure 8:
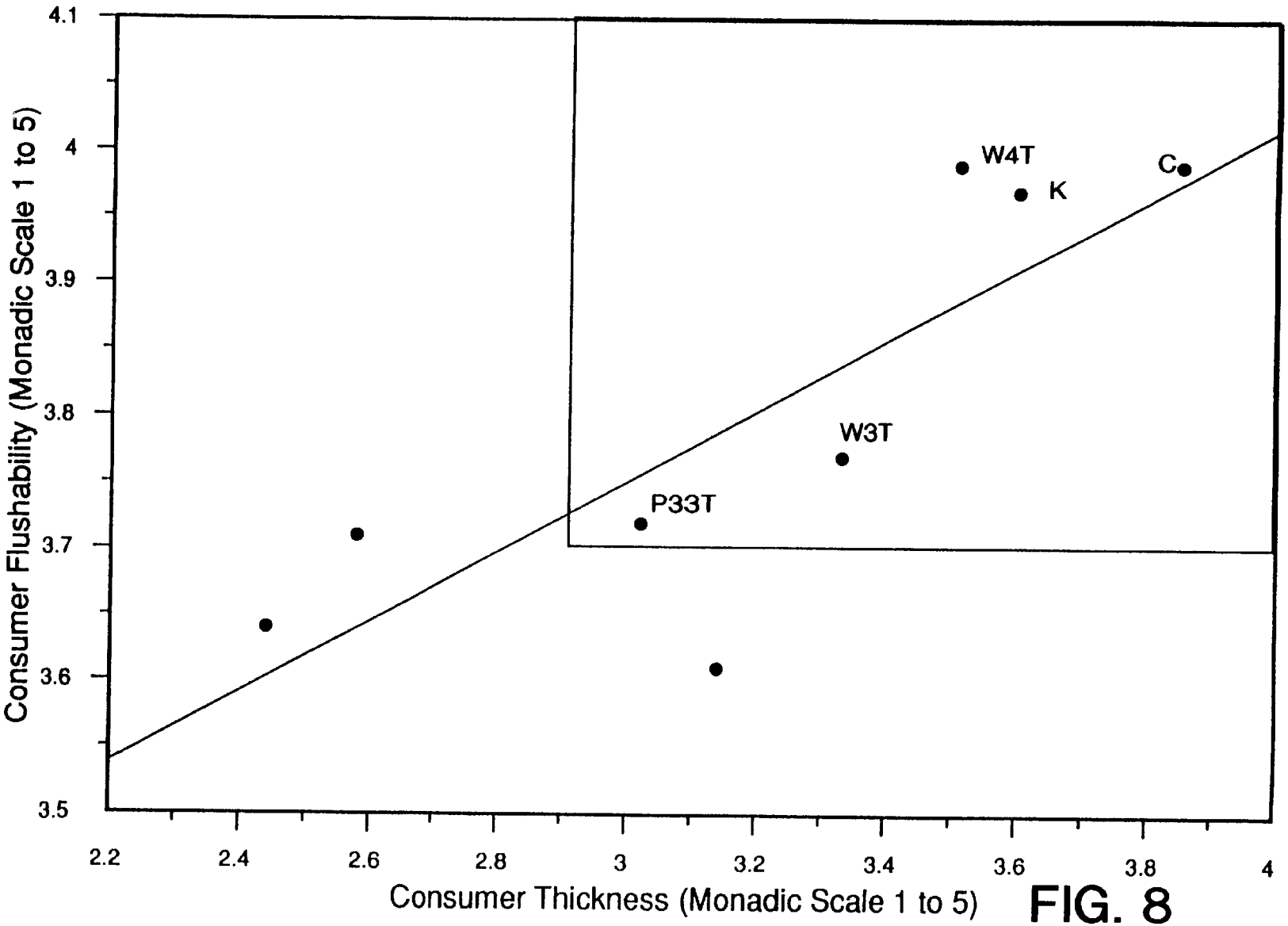
FIG. 8 is a graph illustrating the consumer flushability and thickness for three tissue samples (W4T, W3T, and P33T) of the present invention, as compared to commercially available one-ply CWP and one-ply TAD bathroom products.

FIGS. 7 and 8 demonstrate that the novel one-ply tissue has superior consumer thickness and flushability. In both figures, the novel tissue ranks with the best two-ply or TAD produced one-ply products.

FIGS. 9 to 11 show the effectiveness of use of the high adhesion creping adhesives to keep the creping force up and push the sidedness parameter below 0.3. These graphs illustrate that polyacrylamides are the preferred adhesives even though others are useful. In these figures, HPAE(1) and HPAE(2) are polyaminoamide epichlorohydrin type adhesives commercially sold as Rezosol® 8223 and Rezosol® 8290 by the Houghton International Corporation. In these figures, NA(2) is a commercial polyacrylamide type adhesive sold by the Nalco Chemical Company as Nalcoat® 7538. NA(1) is a developmental polyacrylamide type adhesive.

FIGS. 15 to 20 clearly demonstrate that sidedness is reduced when the crepe angle is kept between 70° and 80°. Keeping the creping angle in the range of about 70°–80° reduces the sidedness for all tissue. Thus, even if a tissue has a sidedness parameter of about 0.3 when manufactured using crepe angle of 87°, the sidedness parameter can be further reduced to a lower value when the creping angle is decreased into the preferred range.

Figure 21:
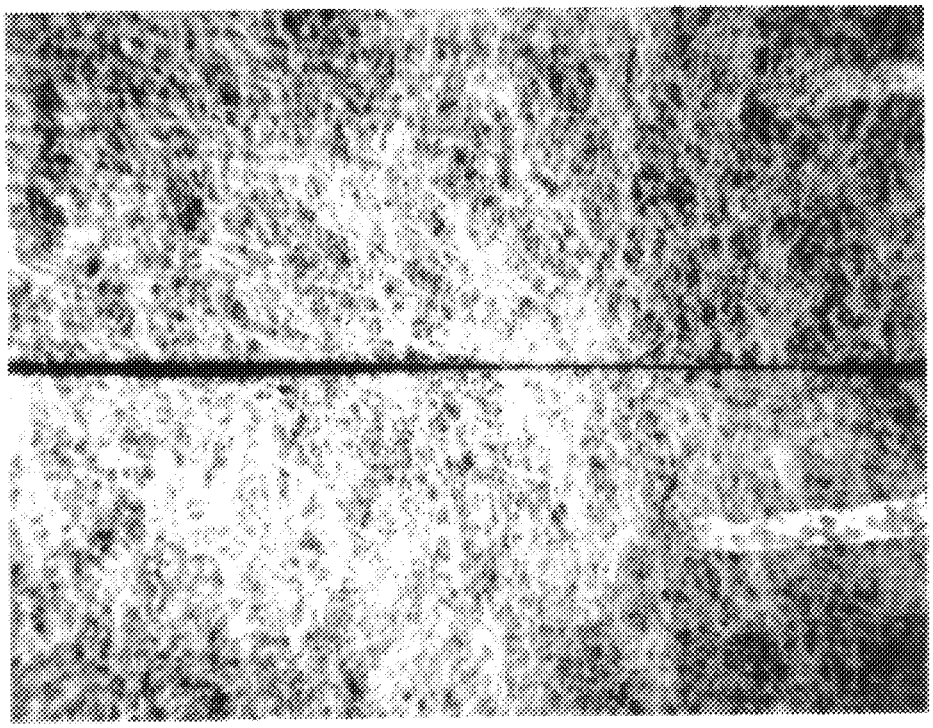
FIG. 21 illustrates that at a 72° creping angle, the geometric mean tensile strength is high while the sidedness parameter has quite a low value.
Figure 21A:
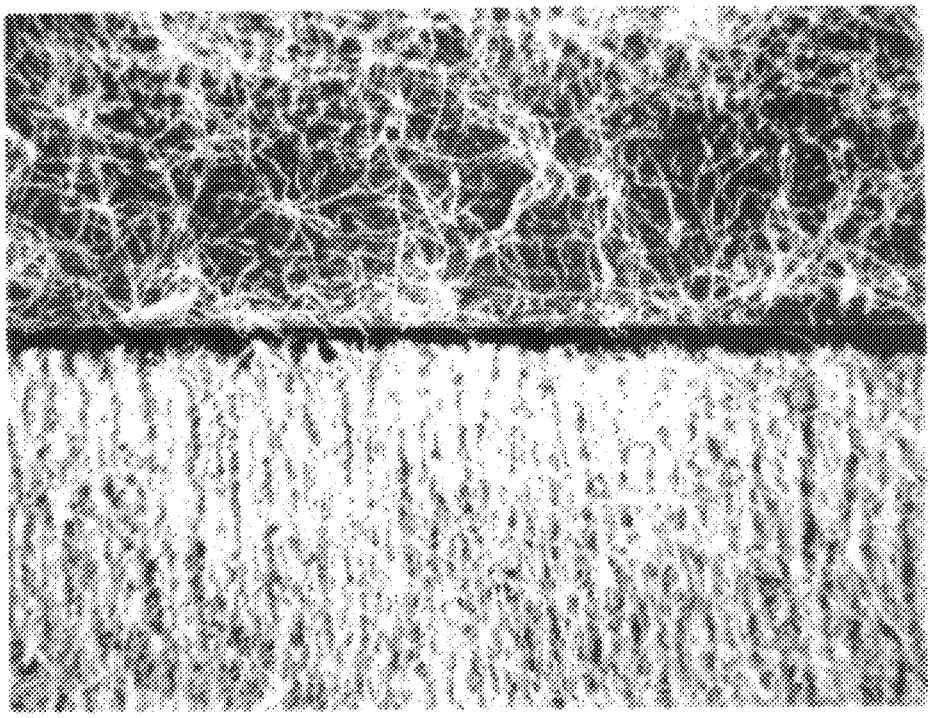

FIG. 21 shows two photographs, one is of the stratified layer and the other is of an otherwise identical product which is not chemically stratified and is used as a control to demonstrate chemical stratification of our tissue. This can be clearly seen on the photographs. The following is a description for the preparation of the chemically stratified tissue photographed in FIG. 22. Two-layered base sheets employing chemical stratification and low angle creping, were manufactured on a paper machine which is a twin wire former. The furnish was 100% Northern softwood kraft with 40% by weight at the Yankee side and 60% at the air side. Three pounds per ton of starch was added to the Yankee side furnish and three pounds per ton of nitrogenous softener was added to the air side furnish. The resulting web was sprayed with softener while on the felt but after vacuum dewatering. The tissue was creped from the Yankee dryer at a creping angle of 72° with a 4% reel moisture at 22% crepe. Calendering of the wet press tissue controlled the caliper to about 40 to 50 mils per eight sheets.

To demonstrate chemical stratification, we use tape pulls to split the sheet into two (top or Yankee and bottom or air side) sections. The sections are representative of 0–50 percent and 51–100 percent from sheet surface (Yankee surface of sheet). Next we used iodine to stain the exposed surfaces of the split sheet. Starch granules present in the section that is preferentially treated with starch will turn blue/black whereas the layer that was not preferentially treated with starch will retain the yellow color of iodine. This evidence of chemical stratification is demonstrated in FIG. 21.

Figure 22:
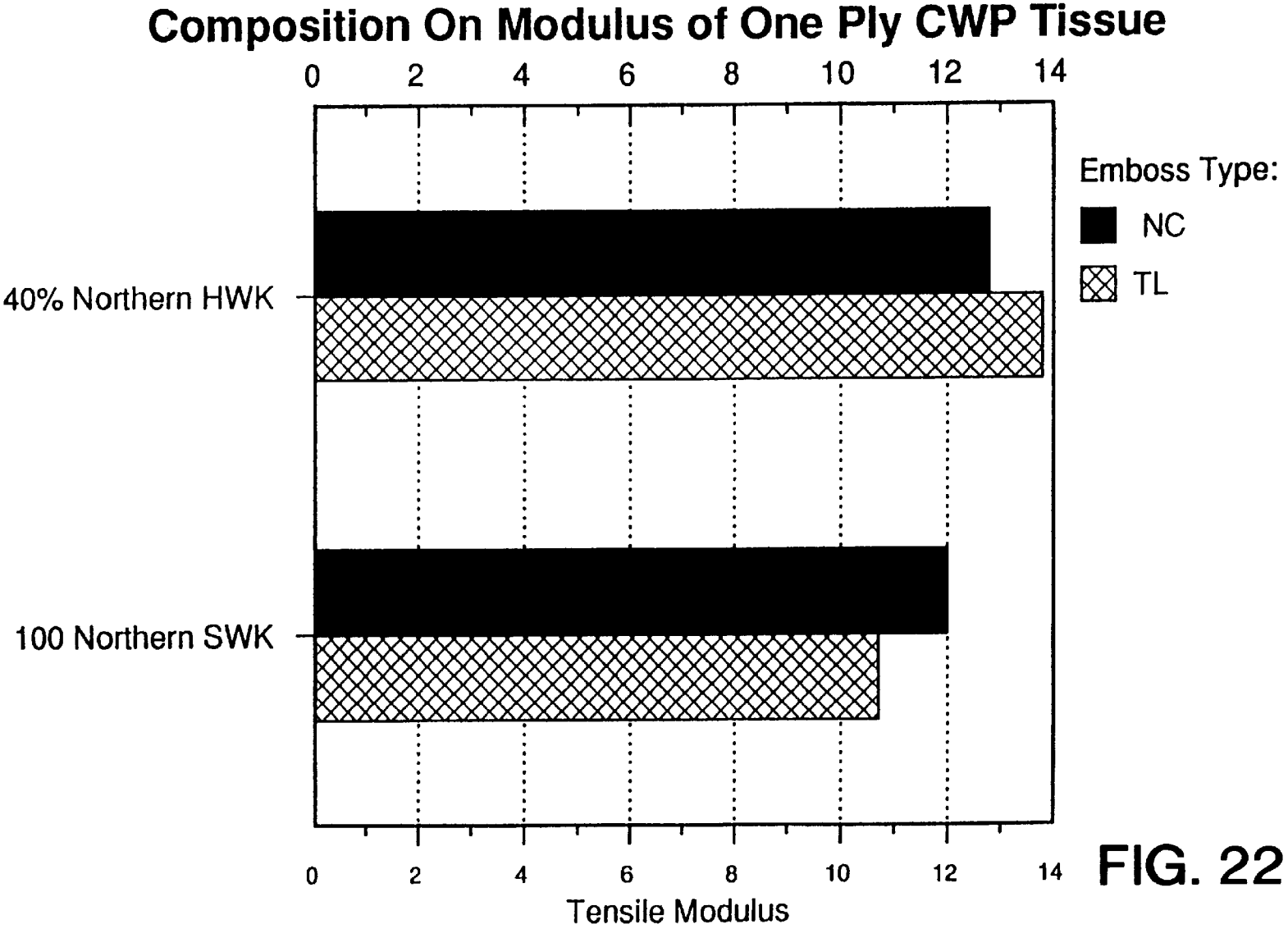
FIGS. 22 and 23 illustrate the effect of Yankee side softwood composition on modulus and friction.
Figure 23:
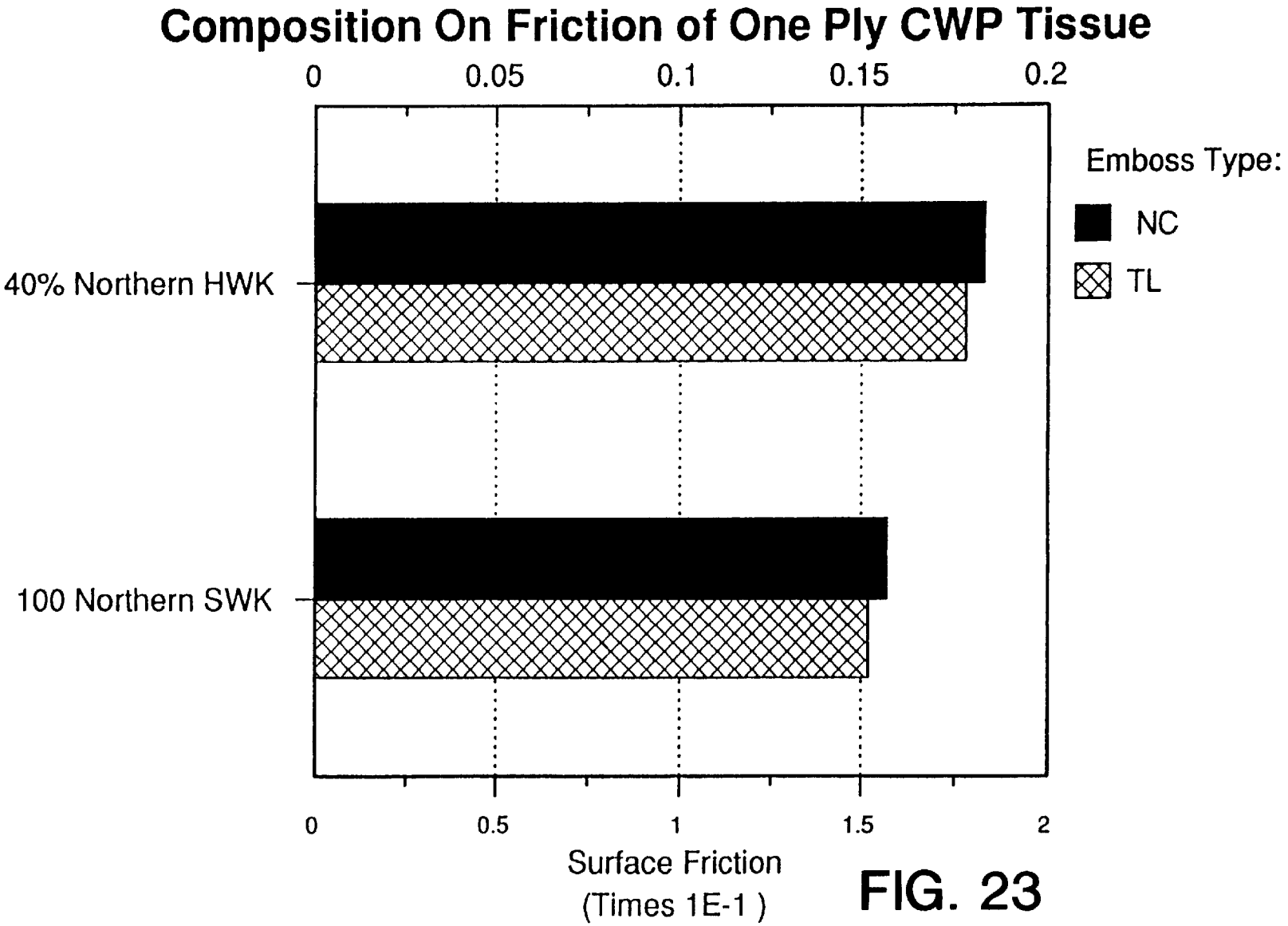

FIGS. 22 and 23 further demonstrate that the use of higher proportion of softwood on the Yankee side in addition to chemical stratification resulted in tissue exhibiting improved modulus and friction. This is contrary to the teachings of Carstens et al. U.S. Pat. No. 4,300,981. It should be understood that softwood is equivalent to having long fibers as measured by the distribution of fiber lengths, fiber widths, and fiber coarseness.

Figure 24:
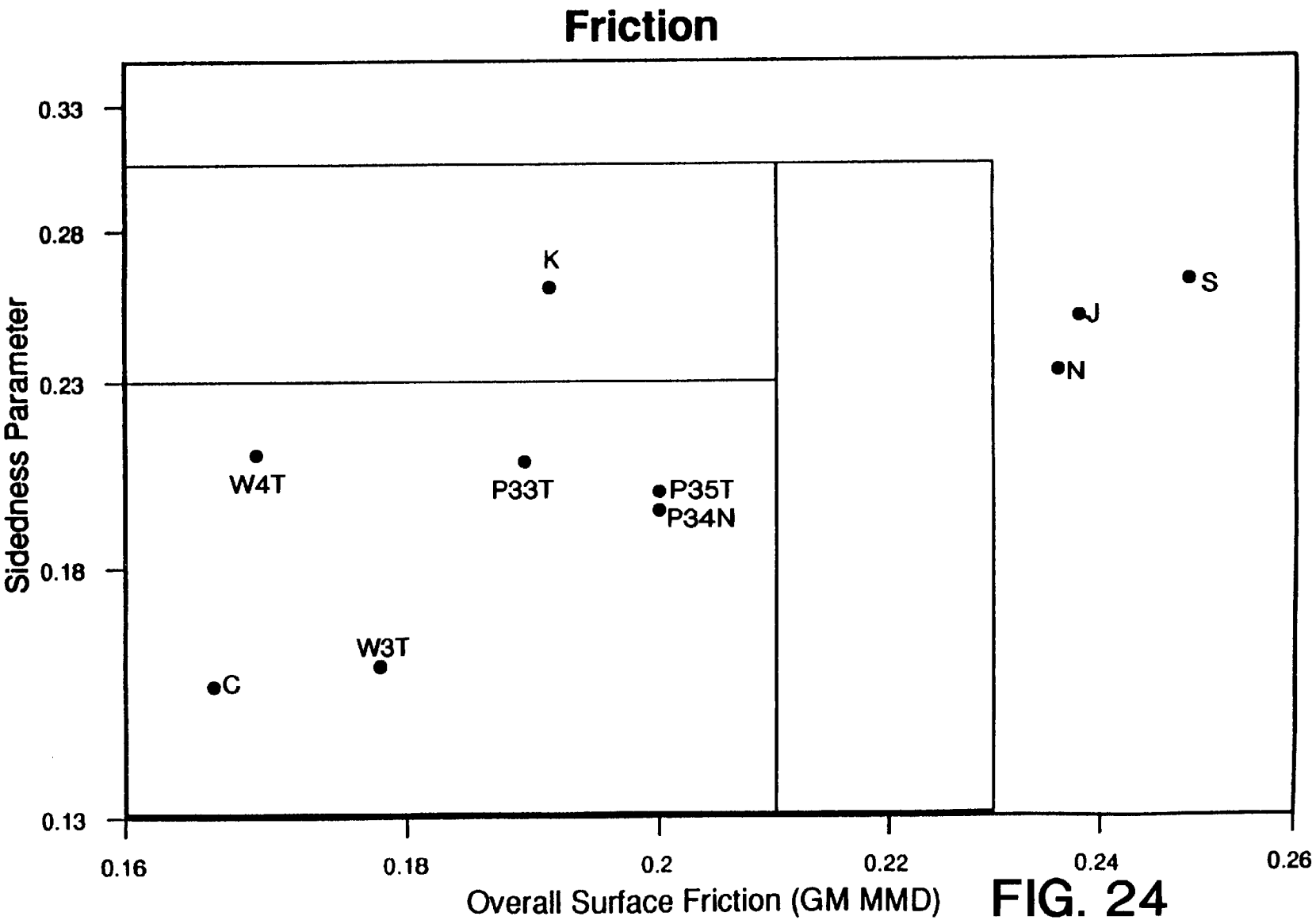
FIG. 24 is a graph illustrating the sidedness versus overall surface friction data wherein these properties of the novel tissue are compared to the properties of commercial one-ply products.

FIG. 24 demonstrates that our tissue has low sidedness and excellent softness. The suitable and preferred properties of the novel tissue are indicated in the boxes on the graph.

In a suitable embodiment of this invention, both starch and softener/debonder may be optionally utilized. Depending on the furnish, the desired results can be achieved using chemical stratification of either the softener/debonder or starch alone but both will preferably be used especially for furnishes either containing no hardwood or furnishes containing large amounts of recycled fiber. By applying these chemicals primarily to one stratum, chemical stratification is suitably achieved. In an alternate embodiment, softener or starch can be present in the separate furnish sources. Advantageously, the concentration of the softener in one furnish source may be from about 2 to about 75 percent by weight of the softener in the other furnish source, it being impractical to obtain absolutely perfect segregation in commercial scale operations. The strength enhancing agent, preferably water soluble starch can be present in an amount of from about 1 to 10 lbs/ton in each furnish source but again it is preferred to concentrate the starch in the Yankee side layer but impractical to achieve perfect segregation between the layers, it being understood that the quantity of the softeners and starch needed depends heavily on the type of cellulosic fibers utilized. The ratio of starch employed is in general proportional to the hardwood content of the furnish. The more hardwood the greater the ratio of starch in that particular furnish. The softener is suitably employed with coarser furnish comprising softwood and recycled fiber.

Suitably, our process for the manufacture of a soft bathroom tissue product having a low sidedness comprises:

providing a moving foraminous support;

providing a stratified headbox adjacent said moving foraminous support adapted to form a nascent web by depositing furnish upon said moving foraminous support, said stratified headbox having at least two plena;

providing wet pressing means operatively connected to said moving foraminous support to receive said nascent web and for dewatering of said nascent web by overall compaction thereof;

providing a Yankee dryer operatively connected to said moving foraminous support and said wet pressing means and adapted to receive and dry the dewatered nascent web;

one plenum of said headbox being adapted to deposit a Yankee side stratum of furnish on said moving foraminous support such that, during drying of said nascent web, said Yankee side stratum will engage said Yankee;

another plenum of said headbox being adapted to deposit a distal stratum of furnish on said moving foraminous support such that, during drying of said nascent web, said distal stratum will be spaced from said Yankee. In our process a furnish is supplied to said one plenum comprising, optionally, strength enhancing agent and cellulosic papermaking fiber chosen from the group consisting of hardwood, softwood, and recycled fibers, and cationic nitrogenous softener/debonder, and another furnish to said other plenum comprising:

cellulosic papermaking fiber chosen from the group consisting of hardwood, softwood, and recycled fibers, and cationic nitrogenous softener/debonder. In the process, a nascent web is formed by depositing said one furnish and said other furnish on said moving foraminous support, the overall concentration of cationic nitrogenous softener/debonder in said nascent web being controlled to between about 1 to about 8 lbs/ton on a dry fiber basis. The concentration of cationic nitrogenous softener/debonder in said Yankee side stratum is kept at about 2% to no more than 75% of the concentration of said cationic nitrogenous softener/debonder in the distal stratum, complete separation being impractical. The nascent web is wet pressed and transferred said to the Yankee dryer. The web is transferred to the Yankee for creping, and the recovering a creped, dried bathroom tissue product; and forming a roll of single-ply tissue. In our process, the relative amounts of softwood fibers, recycle fibers, hardwood fibers, and cationic nitrogenous softener/debonder in each of said strata are controlled so that said creped, dried tissue exhibits a sidedness parameter of less than 0.3; a tensile modulus of no more than 32 grams/percent strain; a GM MMD friction of no more than about 0.225; a cross directional dry tensile strength of at least 200 grams per 3 inches. Preferably, the tissue exhibits a sidedness parameter of less than 0.225; a tensile modulus of no more than 27 grams/percent strain; a GM MMD friction of no more than about 0.21.

TAPPI 401 OM-88 (Revised 1988) provides a procedure for the identification of the types of fibers present in a sample of paper or paperboard and their quality of estimation. Analysis of the amount of the softener debonder chemicals retained on the tissue paper can be performed by any method accepted in the applicable art. For the most sensitive cases, we prefer to use x-ray photoelectron spectroscopy ESCA to measure nitrogen levels, the amounts in each level being measurable by using the tape pull procedure described above combined with ESCA analysis of each "split". Normally, the background level is quite high and the variation between measurements quite high, so use of several replicates in a relatively modern ESCA system such as at the Perkin Elmer Corporation's model 5,600 is required to obtain more precise measurements. The level of cationic nitrogenous softener/debonder such as Quasoft® 202-JR can alternatively be determined by solvent extraction of the Quasoft® 202-JR by an organic solvent followed by liquid chronography determination of the softener/debonder. TAPPI 419 OM-85 provides the qualitative and quantitative methods for measuring total starch content. However, this procedure does not provide for the determination of starches that are cationic, substituted, grafted, or combined with resins. These types of starches can be determined by high pressure liquid chromatography. (TAPPI, Journal Vol. 76, Number 3.)

Tensile strength of tissue produced in accordance with the present invention is measured in the machine direction and cross-machine direction on an Instron tensile tester with the gauge length set to 4 inches. The area of tissue tested is assumed to be 3 inches wide by 4 inches long. In practice, the length of the samples is the distance between lines of perforation in the case of machine direction tensile strength and the width of the samples is the width of the roll in the case of cross-machine direction tensile strength. A 20 pound load cell with heavyweight grips applied to the total width of the sample is employed. The maximum load is recorded for each direction. The results are reported in units of "grams per 3-inch"; a more complete rendering of the units would be "grams per 3-inch by 4-inch strip."

Softness is a quality that does not lend itself to easy quantification. J. D. Bates, in "Softness Index: Fact or Mirage?", TAPPI, Vol. 48 (1965), No. 4, pp. 63A–64A, indicates that the two most important readily quantifiable properties for predicting perceived softness are (a) roughness and (b) what may be referred to as stiffness modulus. Tissue produced according to the present invention has a more pleasing texture as measured by sidedness parameter or reduced values of either or both roughness and stiffness modulus (relative to control samples). Surface roughness can be evaluated by measuring geometric mean deviation in the coefficient of friction using a Kawabata KES-SE Friction Tester equipped with a fingerprint-type sensing unit using the low sensitivity range. A 25 g stylus weight is used, and the instrument readout is divided by 20 to obtain the mean deviation in the coefficient of friction. The geometric mean deviation in the coefficient of friction or overall surface friction is then the square root of the product of the deviation in the machine direction and the cross-machine direction. Sidedness parameter is the ratio of air side MMD to Yankee side MMD multiplied by overall surface friction. The stiffness modulus is determined by the procedure for measuring tensile strength described above, except that a sample width of 1 inch is used and the modulus recorded is the geometric mean of the ratio of 50 grams load over percent strain obtained from the load-strain curve.

The strength and softness enhancing fibers found in tissues of the present invention may be chemically pulped softwood fibers, such as kraft softwood pulps, chemithermomechanical softwood fibers. Chemically pulped hardwood fiber, chemithermomechanical hardwood fibers, recycled fibers, and the like.

Formation of tissues of the present invention as represented by Kajaani Formation Index Number should be at least about 50, preferably about 60, more preferably at least about 65, and most preferably at least about 70, as determined by measurement of transmitted light intensity variations over the area of the sheet using a Kajaani Paperlab 1 Formation Analyzer which compares the transmitivity of about 250,000 subregions of the sheet. The Kajaani Formation Index Number, which varies between about 20 and 122, is widely used through the paper industry and is for practical purposes identical to the Robotest Number which is simply an older term for the same measurement. Tissues not containing bulk-enhancing additives should preferably have a higher Kajaani Formation Index Number of at least about 55.

Unembossed cross directional dry tensile strength of tissues of the present invention will be at least about 200 grams per 3 inches. The total tensile will be at least 500 grams for 3 inches as measured by adding the machine direction and cross direction tensile strengths as measured on an Instron Model 4000: Series IX using cut samples 3 inches wide, the length of the samples being the between perforation distance in the case of machine direction tensile and the roll width in the case of the cross direction and employing the 2 lb load cell with lightweight grips applied to the total width of the sample and recording the maximum load then dividing by the ratio of the actual sample length to the "normal" sample length of 3 inches. The results are reported in grams/3 inch strip.

The uncreped basis weight of each ply of the sheet is desirably from about 10 to about 27 lbs/3000 sq. ft. ream, preferably from about 12 to about 19 for single-ply sheets. Single-ply tissues of the present invention have a creped but calendered caliper of from about 40 to about eighty-thousandths of an inch per 8 plies of tissue, the more preferred tissues having a total caliper of from about 55 to about 75, the most preferred tissues have a caliper of from about 55 to about 60. In the papermaking art, it is known that caliper is dependent on the number of sheets desired in the final product.

When plies of these tissues are embossed, an emboss depth of at least about 0.020 inch should be used for nested embossing. The plies of these tissues are suitably embossed in the range of about 0.02 to about 0.11.

The data in Table II sets forth physical properties of tissue which relate to softness, strength, and sidedness. The one-ply tissue of the present invention shows low sidedness, low overall GM MMD, and low modulus. These values are better than for competitive samples of CWP tissue. In fact, the properties of our tissue exceed or are at least substantially equivalent to the properties of the best TAD process products which we feel validates our claim to have succeeded in combining advantages of TAD and CWP processes.

TABLE II

Physical properties of tissue of the present invention and commercial tissue.

| NAME | PROCESS | AIR GMMMD | Yankee GMMMD | OVERALL GMMMD | SIDED-NESS | GMT | MODULUS g/% STRAIN | REMARKS |
|---|---|---|---|---|---|---|---|---|
| C | TAD | .161 | .173 | .166 | .154 | 601 | 16.1 | COMMERCIAL |
| N | TAD | .237 | .240 | .236 | .233 | 678 | 27.4 | COMMERCIAL |
| K | TAD | .222 | .163 | .191 | .260 | 637 | 22.2 | COMMERCIAL |
| J | CWP | .246 | .234 | .238 | .250 | 685 | 17.2 | COMMERCIAL |
| S | CWP | .259 | .246 | .249 | .262 | 997 | 67.9 | COMMERCIAL |
| W3T | CWP | .192 | .170 | .179 | .158 | 516 | 12.8 | PRESENT INVENTION |
| W4T | CWP | .152 | .188 | .169 | .209 | 600 | 15.4 | PRESENT INVENTION |
| P33T | CWP | .199 | .181 | .189 | .207 | 640 | 11.6 | PRESENT INVENTION |

TABLE II-continued

| NAME | PROCESS | AIR GMMMD | Yankee GMMMD | OVERALL GMMMD | SIDED-NESS | GMT | MODULUS g/% STRAIN | REMARKS |
|---|---|---|---|---|---|---|---|---|
| | | Physical properties of tissue of the present invention and commercial tissue. | | | | | | |
| P35T | CWP | .201 | .200 | .200 | .199 | 687 | 14.9 | PRESENT INVENTION |
| P34N | CWP | .203 | .197 | .200 | .194 | 728 | 23.5 | PRESENT INVENTION |

EXAMPLE 1 (W4T)

Two-layered base sheets employing chemical stratification and low angle creping were manufactured on a paper machine which is a twin wire former. The furnish was 100% Northern softwood kraft with 40% by weight at the Yankee side and 60% at the air side. Three pounds per ton of nitrogenous softener was added to the air side furnish in the wet end, no starch was used in this example. Further data are set forth in Table III. The resulting web was also sprayed with softener while on the felt after vacuum dewatering. The softener utilized was Quasoft® 202-JR manufactured by the Quaker Chemical Corporation. The softener is a mixture of linear amine amides and imidazolines. The hypothesized structure of the softener has been set forth in the specification. The tissue was creped at 22% crepe from the Yankee dryer with a 4% reel moisture using a creping blade maintained at a creping angle of 74.5°. Calendering of the wet press tissue controlled the caliper to about 40 to 50 mils per eight sheets; The calendered base sheet was then converted by embossing in a rubber to patterned steel embossing nip with the Yankee side against the steel roll. The converted paper product formed exhibited a basis weight of 17.9 pounds per 3000 square foot ream, a machine direction tensile strength of 894 grams/3 inches, machine direction stretch of 19.8%, a geometric mean tensile modulus of 15.4 grams/percent strain, and an overall surface friction of 0.169 which is comparable to the excellent TAD products. The sidedness parameter of this tissue was 0.209 which is fully comparable and substantially equivalent to excellent TAD products.

When this tissue was submitted for consumer testing via the Monadic Home Use Test, overall preference was 3.51, and overall softness and strength were judged to be 3.84 and 3.89, respectively. The foregoing tests and the related other tests set forth in the following examples are described in the Blumkenship and Green textbook "State of The Art Marketing Research NTC Publishing Group", Lincolnwood, Ill., 1993.

TABLE III

STRATIFIED PRODUCTS (SHEET STRUCTURE, CHEMICAL ADDITION DOSAGE) AND FURNISH COMPOSITION

| Example | Sheet Structure | Furnish Sources | CHEMICAL ADDITION Yankee Layer | Middle Layer | Air Layer | FURNISH COMPOSITION Yankee Layer | Middle Layer | Air Layer | Comments |
|---|---|---|---|---|---|---|---|---|---|
| 1 | Two-Layer Stratified | Two | None | None | 2.6 #/ton Softener | 40% NSWK | None | 60% NSWK | 3 #/ton Softener Sprayed |
| 2 | Two-Layer Stratified | Two | None | None | 4 #/ton Softener | 40% 50% Fir/50% Alder | None | 60% 50% Fir/50% Alder | Refining |
| 3 | Two-Layer Stratified | Two | 2.5 #/ton Starch (Solvitose-N) | None | None | 40% NSWK | None | 60% NSWK | 3 #/ton Softener Sprayed |
| 4/Proto. 1 | Two-Layer Stratified | Two | None | None | 3 #/ton Softener | 30% Recycled Fiber | None | 70% NSWK | 3 #/ton Softener Sprayed |
| 4/Proto. 2 | Two-Layer Stratified | Two | 1 #/ton Basic Violet 3 Cationic Dye | None | 3 #/ton Softener | 30% Recycled Fiber | None | 70% NSWK | 3 #/ton Softener Sprayed |
| 12/Proto. 1 | Two-Layer Stratified | Two | None | None | 4.6 #/ton Softener | 40% 60/40 NSWK/ Eucalyptus | None | 60% 60/40 NSWK/ Eucalyptus | 2.5 #/ton Softener Sprayed |
| 12/Proto. 2 | Two-Layer Stratified | Two | 2.3 #/ton Starch (Solvitose-N) | None | 4 #/ton Softener | 40% 100% NSWK | None | 40% 100% NSWK | 2.5 #/ton Softener Sprayed |
| 13/Proto. 1A | Two-Layer Stratified | Two | None | None | None | 35% NSWK | None | 65% NSWK | |
| 13/Proto. 1B | Two-Layer Stratified | Two | 2 #/ton Starch | None | None | 35% NSWK | None | 65% NSWK | |
| 13/Proto. 1C | Two-Layer Stratified | Two | 4 #/ton Starch | None | None | 35% NSWK | None | 65% NSWK | |
| 13/Proto. 1D | Two-Layer Stratified | Two | 6 #/ton Starch | None | None | 35% NSWK | None | 65% NSWK | |

TABLE III-continued

STRATIFIED PRODUCTS (SHEET STRUCTURE, CHEMICAL ADDITION DOSAGE) AND FURNISH COMPOSITION

| | | | CHEMICAL ADDITION | | | FURNISH COMPOSITION | | | |
|---|---|---|---|---|---|---|---|---|---|
| Example | Sheet Structure | Furnish Sources | Yankee Layer | Middle Layer | Air Layer | Yankee Layer | Middle Layer | Air Layer | Comments |
| 13/Proto. 2A | Two-Layer Stratified | Two | None | None | None | 65% (54% NSWK/46% NHWK) | None | 35% NHWK | |
| 13/Proto. 2B | Two-Layer Stratified | Two | 2 #/ton Starch | None | None | 65% (54% NSWK/46% NHWK) | None | 35% NHWK | |
| 13/Proto. 2C | Two-Layer Stratified | Two | 4 #/ton Starch | None | None | 65% (54% NSWK/46% NHWK) | None | 35% NHWK | |
| 13/Proto. 2D | Two-Layer Stratified | Two | 6 #/ton Starch | None | None | 65% (54% NSWK/46% NHWK) | None | 35% NHWK | |
| 13/Proto. 3A | Two-Layer Stratified | Two | None | None | 5 #/ton Softener | 65% NSWK | None | 35% NSWK | |
| 13/Proto. 3B | Two-Layer Stratified | Two | 2 #/ton Starch | None | 5 #/ton Softener | 65% NSWK | None | 35% NSWK | |
| 13/Proto. 3C | Two-Layer Stratified | Two | 4 #/ton Starch | None | 5 #/ton Softener | 65% NSWK | None | 35% NSWK | |
| 13/Proto. 3D | Two-Layer Stratified | Two | 6 #/ton Starch | None | 5 #/ton Softener | 65% NSWK | None | 35% NSWK | |
| 14/Proto. 1 | Two-Layer Stratified | Two | None | None | 2.4 #/ton Softener | 65% NSWK | None | 35% NHWK | 3 #/ton Softener Sprayed |
| 14/Proto. 2 | Two-Layer Stratified | Two | 3 #/ton Starch | None | 4 #/ton Softener | 65% NSWK | None | 35% NSWK | 3 #/ton Softener Sprayed |
| 15 | Three-Layer Stratified | Three | None | None | None | 30% Eucalyptus | 40% (62.5% NSWK, 37.5% HBA) | 30% Eucalyptus | Refining of NSWK Crepe angles of 87° and 72° |
| 17 | Three-Layer Stratified | Three | 1 #/ton Starch | 12 #/ton Starch | None | 25% 100% NSWK | 50% (30% SSWK, 40% CTMP, 30% SSWK) | 25% 100% Eucalyptus | Crepe Angles of 85° and 70° |
| 18 | Two-Layer Stratified | Two | 4 #/ton Starch | None | None | 60% 30% NHWK 70% NSWK | None | 40% 100% NSWK | |
| 19 | Three-Layer Stratified | Three | None | None | None | 20% NHWK | 60% (50% Recycled Fiber, 25% Broke, 25% SW) | 20% NHWK | 2 #/ton Softener Sprayed |

EXAMPLE 2 (W3T)

The procedure of Example 1 was repeated except that the overall furnish was 50/50 mixture of Douglas Fir and Alder and embossing was performed with the air side of the sheet against the patterned steel emboss roll. The creping angle was 74.5°. No starch was employed in this example and 4 pounds of softener/debonder per ton of furnish was used. The converted paper product formed exhibited a basis weight of 17.7 pounds per 3000 square foot ream, a machine direction tensile strength of 956 grams/3 inches, machine direction stretch of 20.3, a geometric mean tensile modulus of 12.8 grams/percent strain, and an overall surface friction of 0.179. The sidedness parameter of this tissue was 0.158. When evaluated by Monadic HUT as described above, the overall preference was 3.48, and overall softness and strength were judged to be 3.99 and 3.60, respectively.

EXAMPLE 3 (W5T)

The procedure of Example 1 was repeated except that the base sheet was chemically stratified with-starch and softener and low angle creping was employed to crepe the product off the Yankee. The creping angle was 74.5°. In this example, 2.5 pounds of starch per ton of furnish was added to the Yankee layer but no softener/debonder was utilized at the wet end but three pounds of softener per ton of furnish was sprayed on the sheet while it was on the felt. Further details are set forth in Table III. The converted paper product formed exhibited a basis weight of 17.9 pounds per 3000 square foot ream, a machine direction tensile strength of 1104 grams/3 inches, machine direction stretch of 19.8%, a geometric mean tensile modulus of 14.8 grams/percent strain, and an overall surface friction of 0.213. When evaluated by Monadic HUT as described above, the overall preference for this product was 3.18, and the overall softness and strength were judged to be 3.38 and 3.61, respectively.

EXAMPLE 4 (W6NS)

Two layered base sheets employing chemical stratification, and low angle creping were manufactured on a paper machine which is a twin wire former. The details of this example are set forth in Table III. This example has two prototypes. In prototype two, one pound of cationic dye was used per ton of furnish. In both prototypes, three pounds of softener/debonder were utilized per ton of furnish. The furnish was 70% Northern softwood kraft at the air side and 30% secondary fiber (recycle fiber) at the Yankee side. Three pounds per ton of nitrogenous softener used in Example 1 was added to the air side furnish in the wet end. Variants of this product were made by-also adding basic violet3 (a cationic dye) to the Yankee side furnish. The resulting web was additionally sprayed with softener used in Example 1 while on the felt but after vacuum dewatering. The tissue was creped from the Yankee dryer at a creping angle of 74.5° with a 4% reel moisture at 20% crepe. Calendering of the wet press tissue controlled the caliper to about 40 to 50 mills per eight sheets. The calendered base sheet was then converted by embossing with the Yankee side against the steel roll. The converted paper product formed exhibited a basis weight of 18.6 pounds per 3000 square foot ream, a machine direction tensile strength of 1223 grams/3 inches, machine direction stretch of 22.8%, a geometric mean tensile modulus of 23.7 grams/percent strain and an overall surface friction of 0.194. The sidedness parameter of this tissue was 0.225.

This tissue was subjected to consumer testing through the use of a Mini Home Use Test, where it was directly compared (head to head) to Surpass® bath tissue, a two-ply product made by Kimberly Clark Corporation. The overall preference was 70/30 win in favor of W6NS.

Examples 5–7 illustrate the process for the manufacture of single-layered homogenous tissue utilizing furnishes from, at least two conduits. Table IV sets forth details for the homogenous examples including: composition of furnish one and furnish two, sheet structure, and comments relating to the addition of softener/debonder or starch.

EXAMPLE 5 (P34D)

A single-layer sheet was formed by using furnishes from at least two conduits or sources and applying chemicals of different functionalities to each furnish source and then combining the furnishes at the suction to the fan pump prior to deposition on the forming fabric. Base sheet made by combining the two furnishes was made on a crescent former and creped off the Yankee. The furnish was 60% Southern hardwood kraft and 40k Southern softwood kraft. The resulting web was sprayed with softener used in Example 1 in the amount of 3 lbs/ton of furnish while on the felt but after vacuum dewatering. The tissue was creped from the Yankee dryer using a blade set at a creping angle of 88°. Calendering of the wet pressed tissue controlled the caliper to about 40 to 50 mils per eight sheets. The calendered base sheet was embossed to form finished products. The converted paper product formed exhibited a basis weight of 17.0 pounds per 3000 grams/3 inches, machine direction stretch of 29.3%, a geometric mean tensile modulus of 16.0 grams/percent strain and an overall surface friction of 0.202. The sidedness parameter of this tissue was 0.214.

When this tissue was submitted for consumer testing via the Monadic Home Use Test, overall preference was 3.32, overall softness and strength were judged to be 3.47 and 3.50, respectively.

EXAMPLE 6 (P33T)

The procedure of Example 5 was repeated except that the furnish was 60/40 mixture of Northern hardwood kraft and Northern softwood kraft and the web was creped from the Yankee using a blade maintained at a creping angle of 88°. Details of this experiment are set forth in Table IV, it should be noted that three pounds of softener per ton of furnish was employed. Six pounds of starch was added per ton of furnish. The converted paper product formed exhibited a basis weight of 15.9 pounds per 3000 square foot ream, a machine direction GM tensile strength of 1068 grams/3 inches, machine direction stretch of 27.3, a geometric mean tensile modulus of 11.6 grams/percent strain and an overall surface friction of 0.189. The sidedness parameter of this tissue is 0.207. The overall preference was 3.28 and overall softness and strength were judged to be 3.82 and 3.40, respectively.

EXAMPLE 7 (P35T)

The procedure of Example 6 was again repeated but low angle creping was used to crepe the sheet off the Yankee, the web being creped from the Yankee using a blade maintained at a creping angle of 73°. Details of this experiment are set forth in Table IV, it should be noted that three pounds of softener and fifteen pounds of starch per ton of furnish was employed. The converted paper product formed exhibited a basis weight of 16.7 pounds per 3000 square foot ream, a machine direction GM tensile strength of 1102 grams/3 inches, machine direction stretch of 26.7, a geometric mean tensile modulus of 14.9 grams/percent strain and an overall surface friction of 0.200. The sidedness parameter of this tissue was 0.199. When subjected to evaluation by Monadic HUT as described above, the overall preference was 3.28 and overall softness and strength were judged to be 3.59 and 3.58, respectively. Accordingly, it can be appreciated that the lower creping angles produce tissue exhibiting a significant improvement in perceived softness and a significant decrease in perceived sidedness.

EXAMPLE 8 (P34N)

The procedure of Example 7 was repeated except that a conventional creping angle was used, the web being creped from the Yankee using a blade maintained at a creping angle of 88°. Details of this experiment are set forth in Table IV, it should be noted that three pounds of softener per pound of furnish was employed. Fifteen pounds of starch was used as set forth in Table IV. The converted paper product formed exhibited a basis weight of 14.8 pounds per 3000 square foot ream, a machine direction GM tensile strength of 949 grams/3 inches, machine direction stretch of 27.4, a geometric mean tensile modulus of 15.2 grams/percent strain and an overall surface friction of 0.205. The sidedness parameter of this tissue was 0.194. When tested by sensory panels as described above, the overall preference was 3.17 and overall softness and strength were judged to be 3.04 and 3.60, respectively.

Examples 9 to 11 demonstrate the role of adhesives in producing a tissue having low sidedness. The results of Examples 9–11 have also been set forth in FIGS. 9 to 11 and the results have been discussed hereinabove. In Table IV, details of these experiments are set forth. In none of these examples was starch used. Softener was used in Examples 9 and 11 as set forth in Tables V and VII.

TABLE IV

HOMOGENEOUS EXAMPLES

| | FURNISH SOURCES | | Sheet | |
|---|---|---|---|---|
| Example | Furnish 1 | Furnish 2 | Structure | Comments |
| 5 | 40% NSWK + 10 #/ton Starch | 60% NHWK | Homogeneous | 3 #/ton of softener sprayed in sheet Furnish combined at fan pump |
| 6 | 40% NSWK + 6 #/ton Starch | 60% NHWK | Homogeneous | 3 #/ton of softener sprayed in sheet Furnish combined at fan pump |

TABLE IV-continued

| HOMOGENEOUS EXAMPLES | | | | |
|---|---|---|---|---|
| | FURNISH SOURCES | | Sheet | |
| Example | Furnish 1 | Furnish 2 | Structure | Comments |
| 7 | 40% NSWK + 15 #/ton Starch | 60% NHWK | Homogeneous | 3 #/ton of softener sprayed in sheet Furnish combined at fan pump |
| 8 | 40% NSWK + 15 #/ton Starch | 60% NHWK | Homogeneous | 3 #/ton of softener sprayed in sheet Furnish combined at fan pump |
| 9 | 50% NHWK + 50% NSWK | None | Homogeneous | One source furnish combined in one machine chest and refined together; In some prototypes, softener was employed as shown in Table V. |
| 10 | 50% SHWK + 50% NSWK | None | Homogeneous | Softwood refined only and then combined with unrefined hardwood in machine chest as shown in Table VI. |
| 11 | 50% NHWK + 50% SSWK | None | Homogeneous | One source furnish combined in one machine chest and refined together; In some prototypes, softener was employed as shown in Table VII. |
| 16 Proto. 1A | 40% NSWK | 60% NHWK | Homogeneous | 3 #/ton of softener sprayed Crepe ∠ = 88° |
| 16 Proto. 1B | 40% NSWK + 6 #/ton Starch | 60% NHWK | Homogeneous | 3 #/ton of softener sprayed Crepe ∠ = 88° |
| 16 Proto. 1C | 40% NSWK + 9 #/ton Starch | 60% NHWK | Homogeneous | 3 #/ton of softener sprayed Crepe ∠ = 88° |
| 16 Proto. 1D | 40% NSWK + 6 #/ton Starch | 60% NHWK | Homogeneous | 3 #/ton of softener sprayed Crepe ∠ = 73° |
| 16 Proto. 2A | 40% SSWK + 5 #/ton Starch | 60% SHWK | Homogeneous | 3 #/ton of softener sprayed Crepe ∠ = 88° |
| 16 Proto. 2B | 40% SSWK + 10 #/ton Starch | 60% SHWK | Homogeneous | 3 #/ton of softener sprayed Crepe ∠ = 88° |
| 16 Proto. 2C | 40% SSWK + 15 #/ton Starch | 60% SHWK | Homogeneous | 3 #/ton of softener sprayed Crepe ∠ = 88° |
| 16 Proto. 2D | 40% SSWK + 4 #/ton Starch | 60% SHWK | Homogeneous | 3 #/ton of softener sprayed Crepe ∠ = 73° |
| 16 Proto. 2E | 40% SSWK + 12 #/ton Starch | 60% SHWK | Homogeneous | 3 #/ton of softener sprayed Crepe ∠ = 73° |
| 16 Proto. 2F | 40% SSWK + 15 #/ton Starch | 60% SHWK | Homogeneous | 3 #/ton of softener sprayed Crepe ∠ = 73° |
| 16 Proto. 2G | 40% SSWK + 12 #/ton Starch | 60% SHWK | Homogeneous | 3 #/ton of softener sprayed Crepe ∠ = 83° |

EXAMPLE 9

A furnish of 50% Northern hardwood kraft and 50% Northern softwood kraft is prepared without using the other sidedness control tools described above to demonstrate the effect of using high adhesion creping. The papermaking machine is an inclined wire former with a Yankee drier speed of 100 ft. per minute. As set forth in Table V, two-tenths of a pound of the specified adhesive per ton of furnish was sprayed directly on the Yankee; the amount of softener sprayed on the Yankee side of the sheet is set forth in Table V. The creping angle was maintained constant at 72°.

The properties of the paper products formed are set forth in Table V. The table shows that with the use of HPAE 1 polyaminoamide adhesive, softener has to be added in amounts less than four pounds per ton of furnish to keep the two sidedness low.

TABLE V

Surface friction components and adhesion for uncalendered one-ply base sheet with softener sprayed on air side of sheet on Yankee.

| Adhesive (0.2#/T) | GMMMD Overall | GM Air Side (A) | GM Yankee Side (Y) | Sidedness Parameter S | Peel Force (g/12") | Softener (#/T)** |
|---|---|---|---|---|---|---|
| HPAE (1) | 0.325 | 0.380 | 0.270 | 0.457 | 296 | 1 |
| NA1 | 0.249 | 0.275 | 0.223 | 0.307 | 714 | 1 |
| HPAE (1) | 0.553 | 0.654 | 0.451 | 0.802 | 104 | 4 |
| NA1 | 0.306 | 0.340 | 0.272 | 0.382 | 366 | 4 |

* 50/50 Burgess hardwood kraft/Northern softwood kraft furnish (500 CSF), homogenous sheet, wire speed = 100 ft/min
BW = 14.5 #/rm (o.d.), 8 deg. bevel, 18% crepe
**Quasoft ® 202-JR softener sprayed on the Yankee It can be appreciated that even use of high adhesion creping alone is sufficient to substantially reduce the sidedness of the sheet and move it toward the preferred range.

EXAMPLE 10

A furnish of 50% southern hardwood kraft and 50% Northern softwood kraft' was prepared without stratification of either chemicals or fiber. The papermaking machine was a crescent former with a Yankee drier speed of 1,852 ft. per minute. Calendering was utilized to control the caliper to approximately 29 mils per eight sheets. About 0.15 pounds of adhesive per ton of furnish was sprayed directly on the Yankee. In this example neither starch nor a softener/debonder were added. Further details are set forth in Table VI. The creping angle was kept at 72°. The sidedness parameter was 0.225 to 0.27 and the sheet tension varied between 387 gms/24" to 1,634 gms/24".

TABLE VI

Surface friction components and adhesion (as measured by sheet tension) for calendered one-ply base sheet with release oil.

| Spray*** Material | GMMMD Overall | GM Air Side (A) | GM Yankee Side (Y) | Sidedness parameter S** | Sheet Tension (g/24") |
|---|---|---|---|---|---|
| 1 | 0.23 | 0.25 | 0.21 | 0.274 | 387 |
| 2 | 0.21 | 0.23 | 0.18 | 0.268 | 857 |
| 3 | 0.21 | 0.22 | 0.20 | 0.231 | 1634 |

* 50/50 Southern hardwood kraft, Northern softwood kraft refining = 30 hp, 15 deg. bevel, 18% crepe, homogenous sheet, wire speed = 1,852 ft/min, BW = 17 #/rm (4% moisture).
**Sidedness parameter S calculated as set forth on page 17 of the specification.
***1 = Release oil (1 #/T)
2 = 0.15 #/T HPAE (2) + 1.0 #/T Release oil
3 = 0.15 #/T NA (2) + 1.0 #/T Release oil

EXAMPLE 11

A furnish of 50% Northern hardwood kraft and 50% Northern softwood kraft was prepared. The papermaking machine was an inclined wire former with a Yankee drier speed of 100 ft. per minute. Two-tenths of a pound of the adhesive per ton of furnish was sprayed on the Yankee. About 0 to 4 pounds of the softener was sprayed on the air side of the web. In this example, no starch was added. Further details are set forth in Table VII. The creping angle was 72°.

The properties of the paper products formed are set forth in Table VII. The softener was sprayed on the air side of the sheet and the adhesive was sprayed on the Yankee metal.

TABLE VII

| Adhesive (0.2#/T) | GMMMD Total | GM Air Side (A) | GM Yankee Side (Y) | Sidedness Parameter S** | Peel Force (g/12") | Softener (#/T)*** |
|---|---|---|---|---|---|---|
| HPAE (2) | 0.286 | 0.310 | 0.262 | 0.338 | 628 | 0 |
| HPAE (2) | 0.283 | 0.301 | 0.266 | 0.320 | 620 | 0.2 |
| HPAE (2) | 0.281 | 0.337 | 0.225 | 0.421 | 545 | 1 |
| HPAE (2) | 0.365 | 0.398 | 0.331 | 0.439 | 220 | 4 |

* 50/50 Northern hardwood kraft/Northern softwood kraft furnish (500 CSF), homogenous sheet, wire speed = 100 ft/min
BW = 14.5 #/rm (o.d.), 8 deg. bevel, 18% crepe
**Sidedness parameter S calculated as set forth on page 17 of the specification.

Examples 12, 13, and 14 illustrate that our novel process allows us to generate tissue products made at high levels of softwood that have softness values that are, at equivalent strength, comparable in softness to sheets containing significant (35% or more) amounts of hardwood. Further details on these examples are set forth in Table III.

EXAMPLE 12

Base sheets employing chemical stratification were manufactured on a papermaking machine which is a twin wire former with a Yankee drier speed of 4,000 ft. per minute. Two furnishes were used during the trial: a 60/40 blend of Northern softwood kraft/Eucalyptus and a 100% Northern softwood kraft. In both cases the furnish used in each of the base sheet's two layers was the same; however, softener was added to the air side furnish of the sheet. For the 100% Northern softwood kraft sheet, starch was added to the Yankee side furnish. Further details in this example are set forth in Table III.

The base sheets were converted to a finished tissue product using a number'of emboss patterns. Data on the strength and softness of these converted products, along with that for some commercial products is shown in Table VIII and in FIGS. 22 and 23.

TABLE VIII

Sensory Softness of Tissue Products

| Commercial Emboss Pattern Used by Assignee | GMT | Sensory Panel Softness |
|---|---|---|
| Furnish: 60% Northern softwood kraft/40% Euc. | | |
| Tl | 422 | 18.20 |
| Nc | 452 | 17.92 |
| Chl | 441 | 17.81 |
| Furnish: 100% Northern softwood kraft | | |
| Tl | 408 | 18.23 |
| Nc | 440 | 17.90 |
| Chl | 526 | 17.41 |

TABLE VIII-continued

Commercial Products

| Name | GMT | Sensory Panel Softness |
|---|---|---|
| Q | 674 | 17.54 |
| C | 596 | 17.41 |
| CO | 514 | 18.56 |
| K | 586 | 16.70 |

Note: A sensory softness difference of 0.4 is considered statistically significant at 95% confidence level.

As is evident from the softness values, the chemically stratified one-ply products are quite similar in softness to commercial two-ply CWP and one-ply TAD products.

EXAMPLE 13

Two-layer, one-ply tissue products were made on a papermaking machine which is an inclined wire former with a Yankee drier speed of 100 ft. per minute. The layering procedures and furnish compositions for the products are shown in Table IX. The products were produced at a basis weight of 17 lbs/ream. Starch was added to the Yankee side furnish at levels of 0–6 lbs/ton of furnish to produce products having different strength levels. Further experimental details for this experiment are set forth in Table III.

TABLE IX

Furnish of One-Ply Tissue prototypes

| Prototype Number | Yankee Side % of Total Sheet Furnish | Yankee Side % Furnish | Air Side % of Total Sheet Furnish | Air Side % Furnish |
|---|---|---|---|---|
| 1 | 35 | 100% Northern Softwood Kraft | 65 | 100% Northern Hardwood Kraft |
| 2 | 65 | 54% Northern Softwood Kraft 46% Northern Hardwood Kraft | 35 | 100% Northern Hardwood Kraft |
| 3 | 65 | 100% Northern Softwood Kraft | 35 | 100% Northern Softwood Kraft |

As shown in Table III, product 3 was prepared in four versions all had five pounds of softener added but the amount of starch added was as follows: for prototype 3(A) 0, 3(B) two pounds per ton of furnish, 3(C) four pounds per ton of furnish, and 3(D) 6 pounds per ton of furnish. Thus, although the furnish on both sides of the sheet are the same for this product, the sheet has been chemically stratified by treating the Yankee side with a strengthening agent and the air side with a softening chemical.

The tissues base sheets were embossed using the Tl pattern at an emboss depth of 0.0731" to produce finished tissue rolls.

Figure 13:
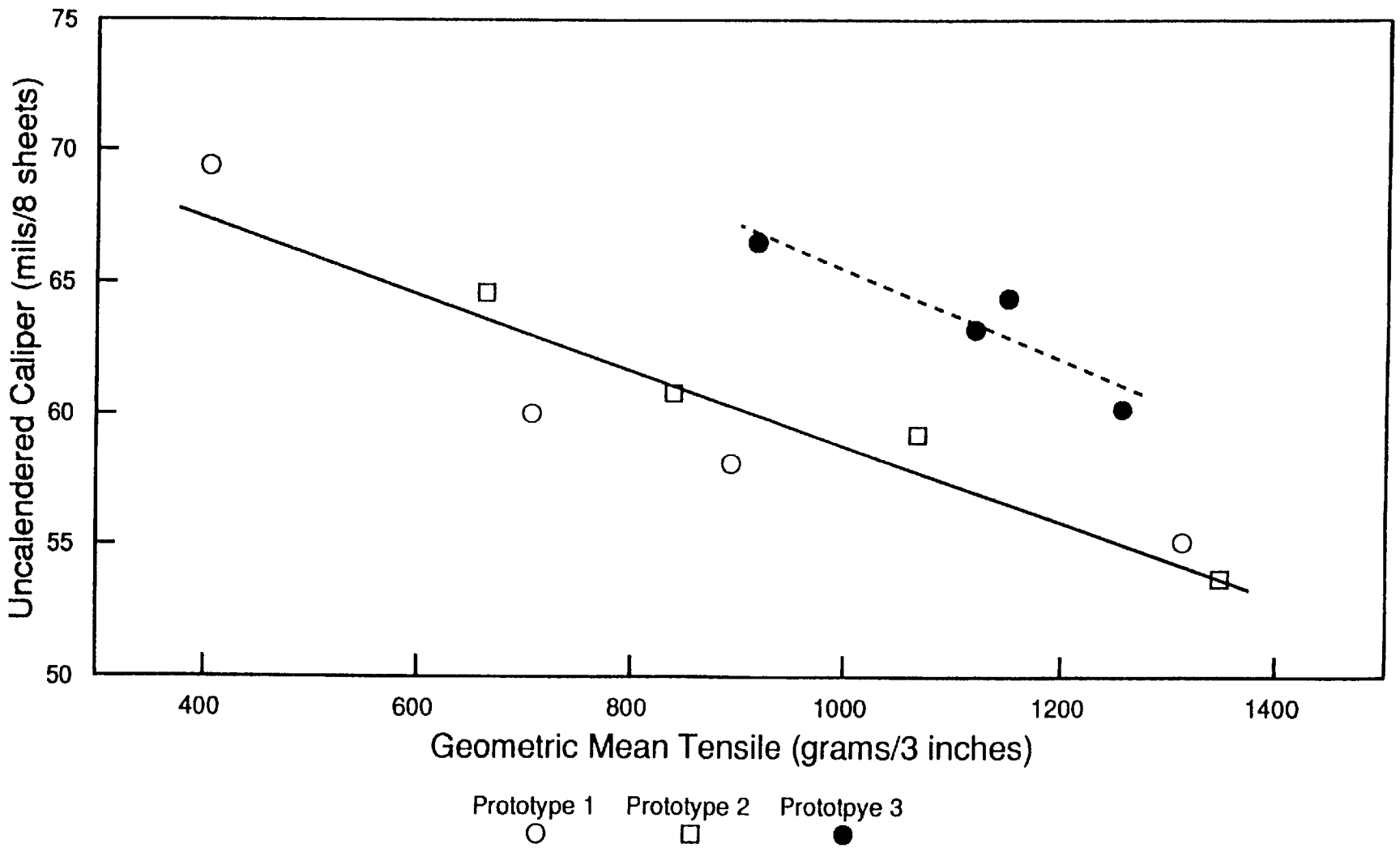
FIG. 13 is a graph illustrating the uncalendered base sheet-caliper of the products as a function of their tensile strength. As can be seen from the graph, use of softwood kraft fibers in both layers of the sheet has allowed the generation of a sheet with higher bulk at a given tensile strength than was possible for the sheets containing both softwood kraft and hardwood kraft. However, it would be expected that the all-softwood kraft sheet would be less soft than would the sheets made from fiber blends, as the air side of its sheet contains coarser softwood fibers as compared to the other sheets which have a less-coarse hardwood furnish on their air sides.

FIG. 13 shows the uncalendered base sheet caliper of the products as a function of their tensile strength. As can be seen from the graph, use of the softwood kraft fibers in both layers of the sheet has allowed the generation of a sheet with higher bulk at a given tensile strength than was possible for the sheets containing both softwood kraft and hardwood kraft. However, it would be expected that the all-softwood kraft sheet would be less soft than would the sheets made from fiber blends, as the air side of its sheet contains coarser softwood fibers as compared to the other sheets which have a less-coarse hardwood furnish on their air sides.

Figure 14:
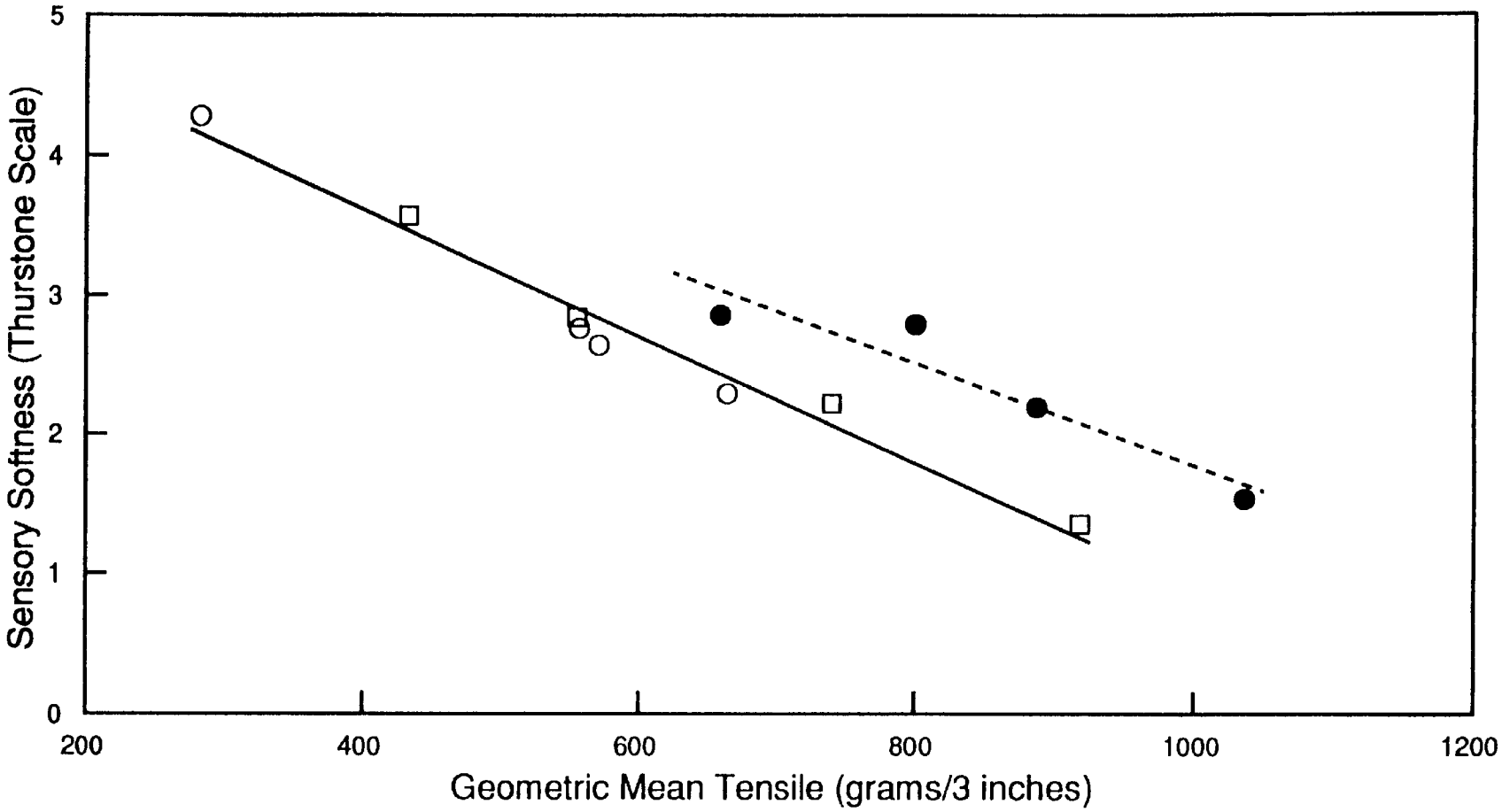
FIG. 14 is a graph illustrating the sensory softness of the converted products made from the various base sheets, demonstrating that the all-softwood kraft sheets made using chemical stratification can be as soft as the products made with the hardwood kraft/softwood kraft furnish or even softer. The use of chemical stratification has allowed the production of a one-ply product with both high softness and high bulk.

FIG. 14, which shows the sensory softness of the converted products made from the various base sheets, shows that the all-softwood kraft sheets made using chemical stratification is as soft or softer than the products made with the hardwood kraft/softwood kraft furnish. The use of chemical stratification has allowed the production of a one-ply product with both high softness and high bulk.

EXAMPLE 14

One-ply, two layer tissue base sheets were made on a papermaking machine which is a crescent former with a Yankee drier speed of 1,700 ft. per minute. Two furnish compositions were employed, a 65% Northern softwood kraft; 35% Northern hardwood kraft furnish with all of the Northern softwood kraft on the Yankee side of the sheet, and a 100% Northern softwood kraft furnish. This latter furnish, however, was divided 65%/35% between the Yankee and air layers. The stock on the air side was treated with four pounds of softener per ton of furnish. To obtain the desired strength, three pounds of starch per ton of furnish were added to the Yankee side of the sheet. For the Northern softwood kraft/Northern hardwood kraft furnish, 2.4 pounds of softener per ton of furnish were added to the Yankee side to decrease the tissue strength to the desired level. Further details for this example are found in Table III.

The base sheets were converted to finished tissue product using the Tl emboss pattern at a penetration depth of 0.092". The products were tested for sensory softness by a softness panel.

The results of the softness panel are shown in Table X, below. As can be seen, the two products have similar sensory softness values, indicating that the use of chemical stratification has allowed the use of a higher fraction of the coarser softwood kraft fibers in the tissue furnish with no decrease in softness.

TABLE X

Sensory Softness of One-Ply Tissue Prototypes

| Furnish | GM Tensile (g/3") | Sensory Panel Softness |
|---|---|---|
| 60% Northern Softwood Kraft<br>40% Northern Hardwood Kraft | 559 | 16.81 |
| 100% Northern Softwood Kraft | 592 | 16.73 |

Low Creping Angle Examples

Examples 15, 16, and 17 show that the difference between air and Yankee side friction deviation values were advantageously decreased by the use of a creping angle that is lower than that which is considered optimum for the production of two-ply products. These examples demonstrate the advantage of low angle creping.

EXAMPLE 15

The base sheets were manufactured on a paper machine using foam forming. The base sheet basis weight was targeted at 17 lbs/ream. The sheets were all three layer, with the outside layers, which were composed of 100% Eucalyptus, each making up 30% of the total sheet. The remaining 40% of the sheet was composed of a blend of 62.5% Northern softwood kraft; 37.5% HBA converted pulp which provides bulk. Sheets of various strength levels were made by refining the Southern Softwood Kraft. Further details are set forth in Table III. In this example, neither starch nor softener/debonder was used. The sheets were made at a machine (Yankee) speed of 2,000 ft/min and employed a 20% crepe ratio. The base sheets were creped at either an 87 or a 72 degree crepe angle. The angle was changed by using either a 15 or 0 degree beveled creping blade.

The base sheets were converted to finished tissue rolls using the Tl emboss pattern. The sheets were embossed at a depth of 0.073" with the air side of the sheet against the steel emboss roll.

Figure 15:
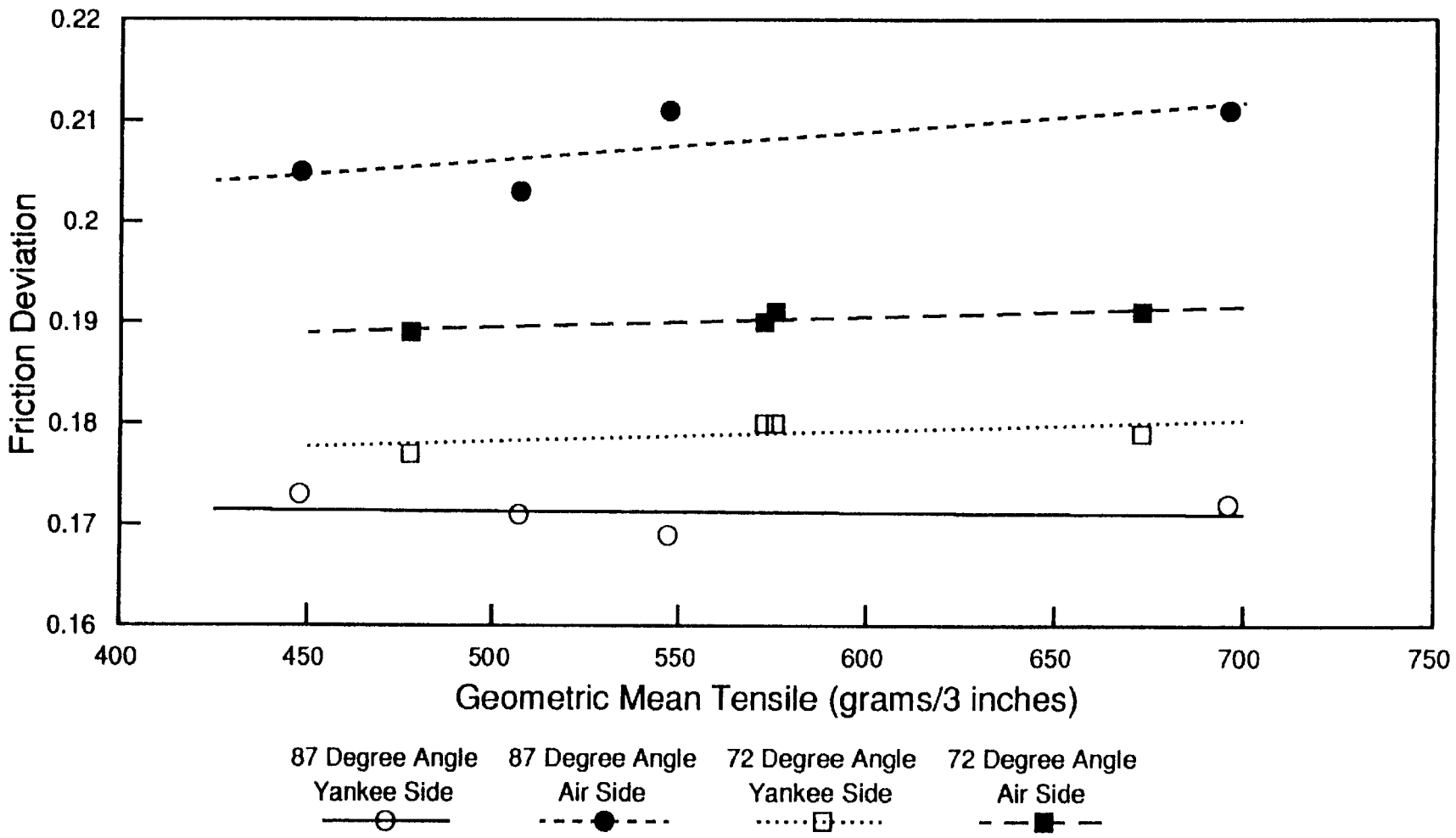
FIGS. 15, 16, and 17 are graphs which illustrate that when the creping angle is lowered from 87° to 70°–80°, the friction deviation of the two sides of the one-ply tissue are reduced. Thus, the sidedness is substantially minimized.
Figure 18:
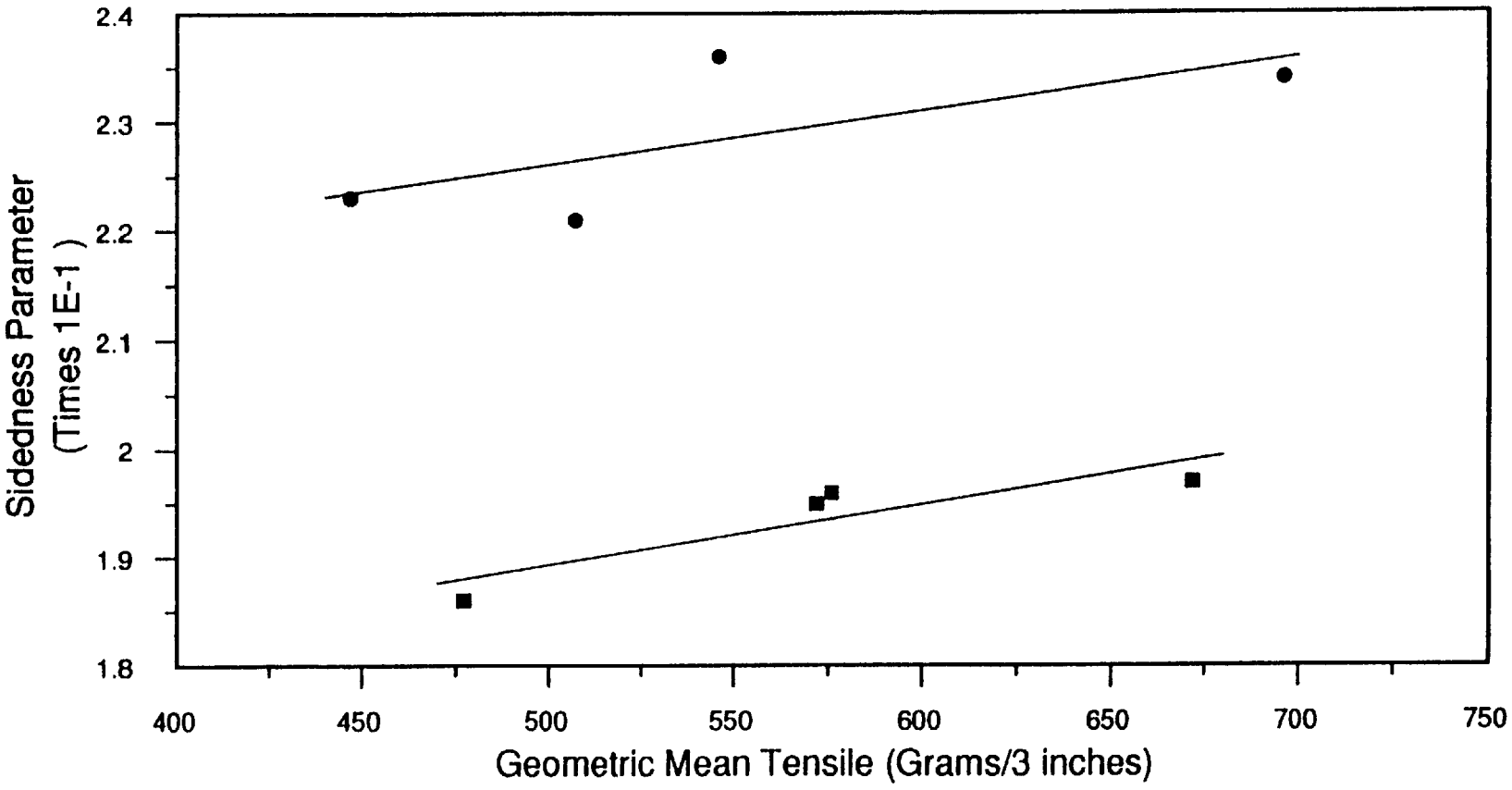
FIGS. 18, 19, and 20 are graphs which compare the sidedness parameter with geometric mean tensile.

FIG. 15 shows the Yankee and air side friction deviation values for the two sides of the embossed tissue sheets as a function of their tensile strengths. As can be seen from the figure, the MMD values for the Yankee and air sides of the tissues made from base sheets creped at the 72 degree angle are much closer together than are those for the products made from base sheets creped at an 87 degree angle. Thus, the products creped at the lower angle will have less two-sidedness than will the tissues creped using the higher crepe angle. This lower two sidedness for the tissue whose base sheet was creped at the 72° angle is also illustrated in FIG. 18, which plots the sidedness parameter as a function of geometric mean tensile strength.

EXAMPLE 16

Tissue base sheets were made on a papermaking machine which is a crescent former with a Yankee drier speed of 2,030 ft. per minute, the crepe ratio was 25% at a targeted basis weight of 17 lbs/ream. The base sheets were water formed and homogenous. The furnish for the tissues was a blend of 60% hardwood kraft/40% softwood kraft. Two different furnish blends were employed: an all-Northern furnish and an all-Southern furnish. The amount of starch used varied from about zero pounds per ton of furnish to fifteen pounds per ton of furnish. Three pounds of softener were sprayed on the air side per ton of furnish. Further details for this example are set forth in Table IV. The strength of the tissue base sheets was controlled by adding starch to the softwood kraft portion of the furnish. The Yankee speed for this example was 2,030 ft/min; the crepe ratio was 25%. The sheets were made at creping angles that varied between 88 and 73 degrees. The angle was varied by changing the crepe blade from a 0-degree (square) blade to blades having bevel angles of up to 15 degrees.

Some of the base sheets were converted into finished product. The sheets were embossed using the Tl pattern at an emboss depth of 0.090". The Yankee side of the sheet was placed against the steel emboss roll during the embossing process.

Figure 16:
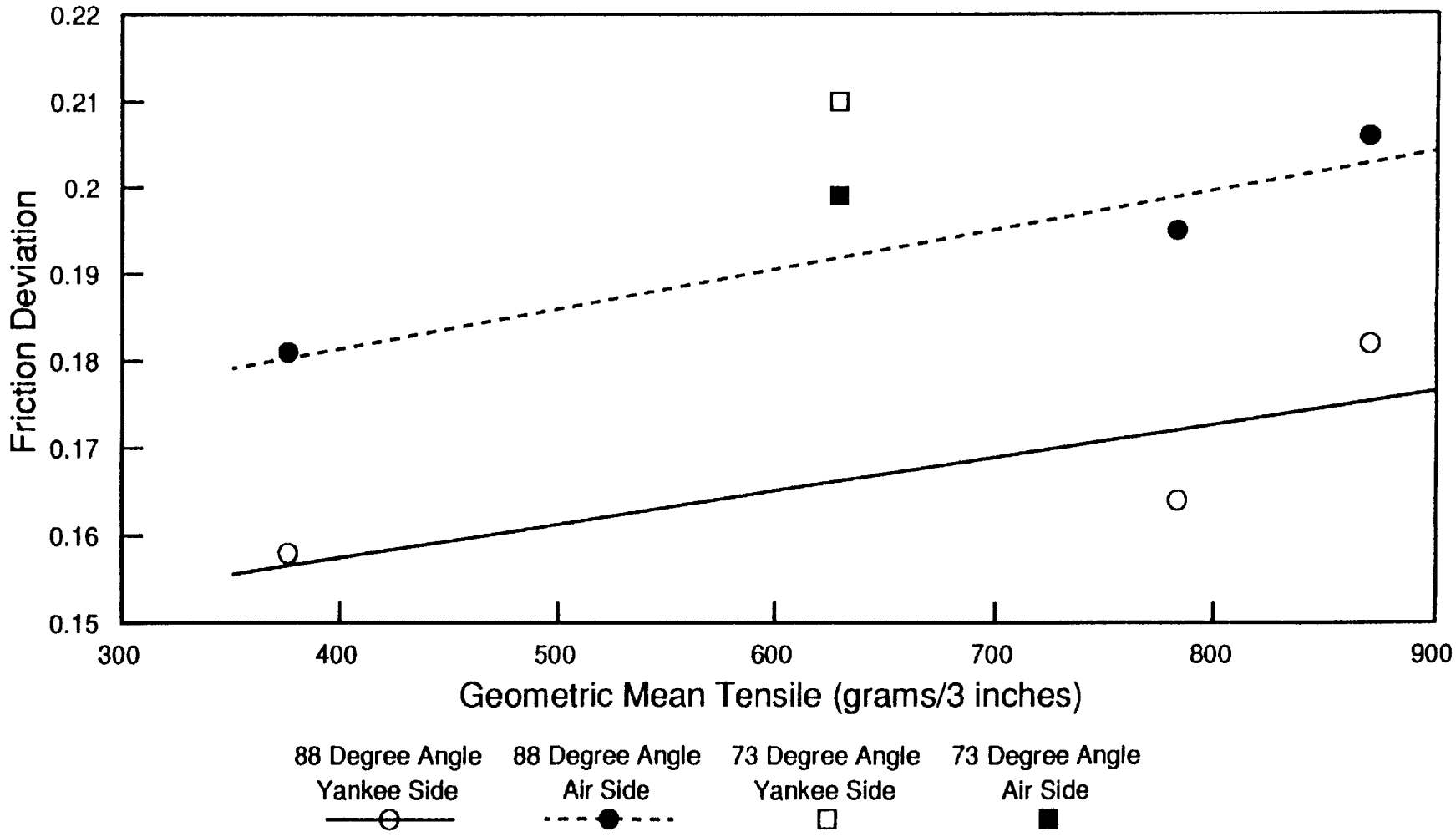
Figure 17:
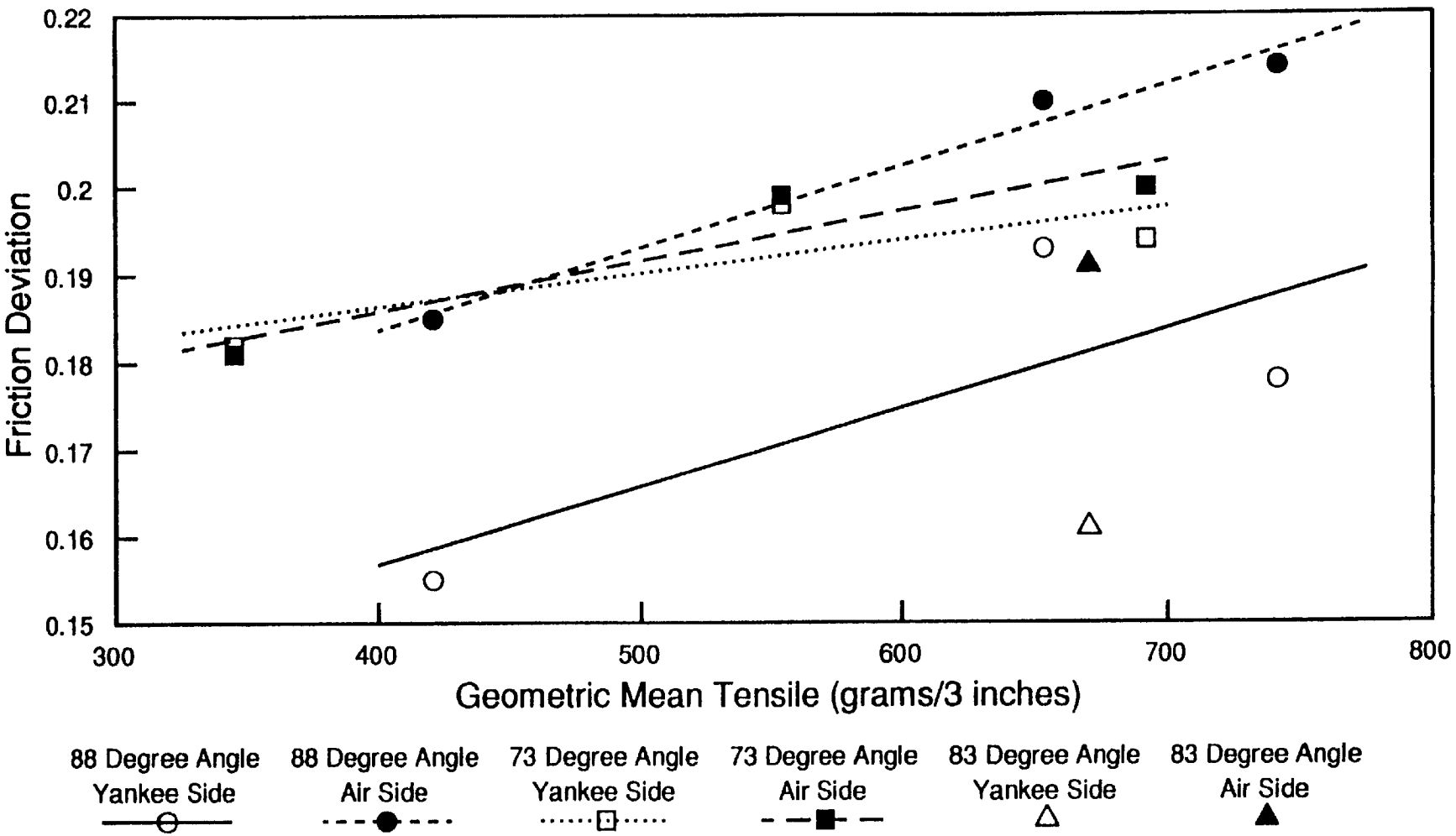
Figure 19:
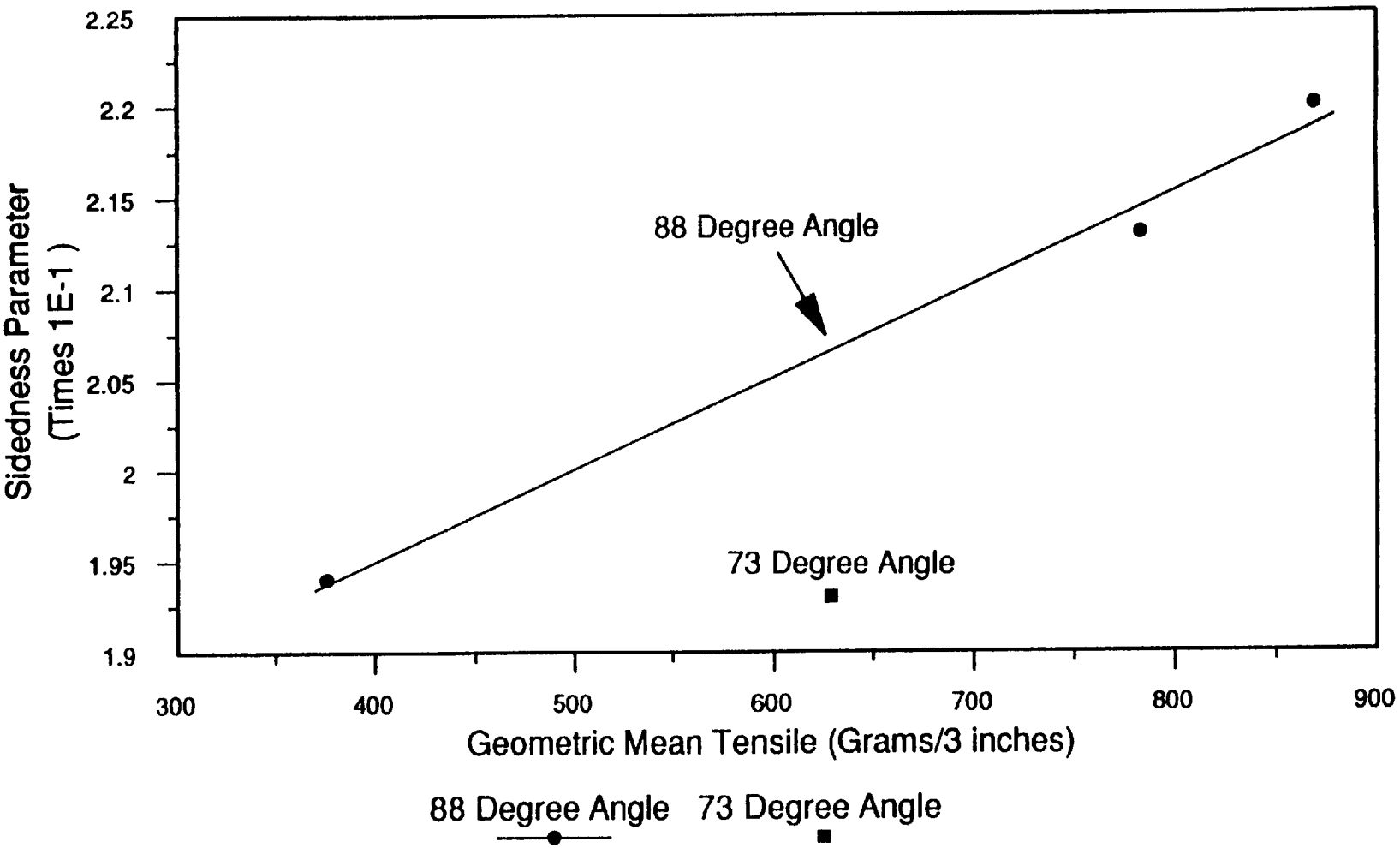
Figure 20:
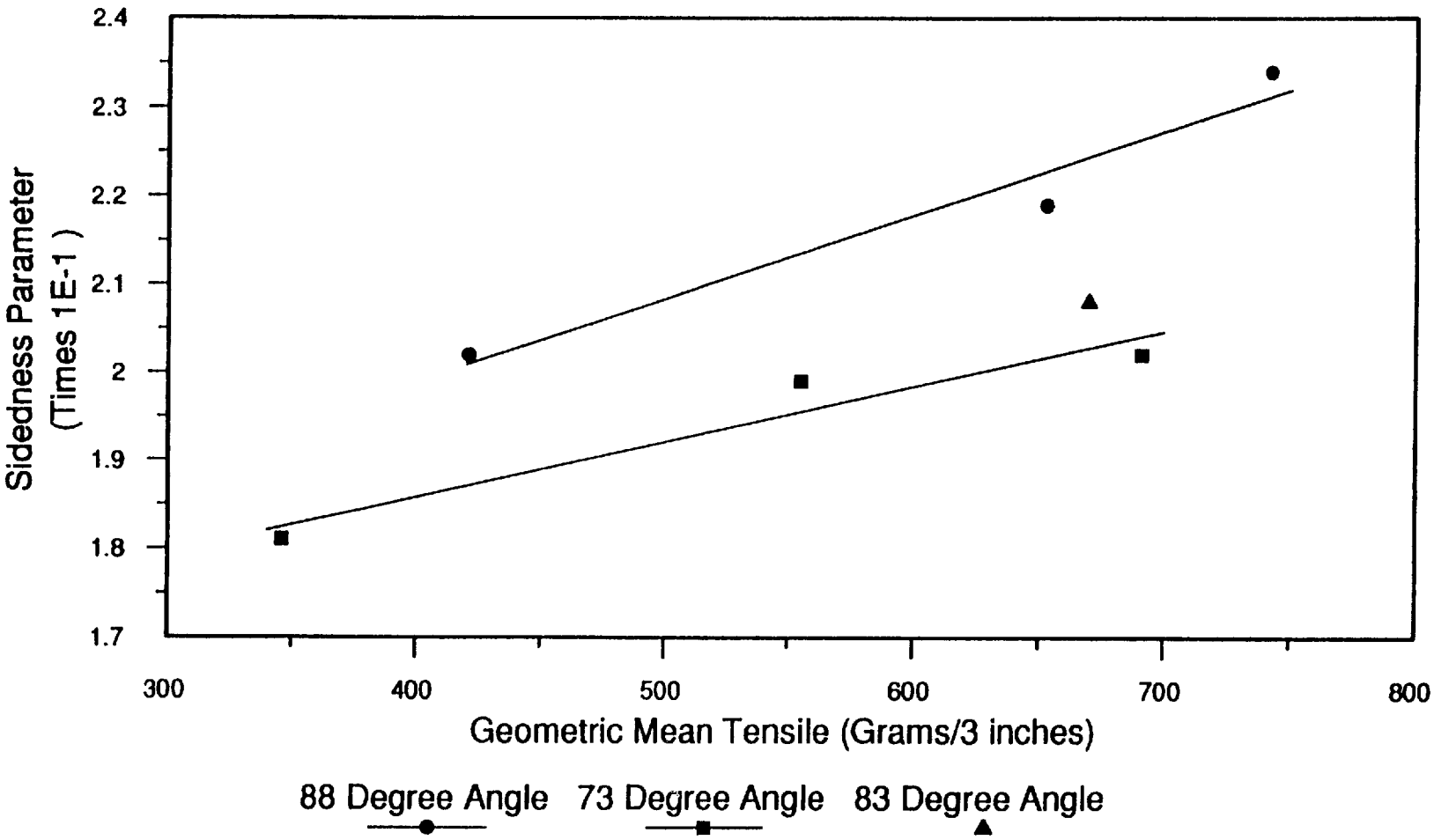

The friction deviation values for the Yankee and air sides of the embossed tissue product as a function of their strength are shown in FIG. 16 and 17. FIG. 16 shows the results for the tissue made from the all-Northern furnish, while the values for the products made from the Southern furnish are shown in FIG. 17. In both cases the GM MMD values for the products whose base sheets were manufactured using the 73° crepe angle are closer to each other than are those tissues whose base sheets were creped at 88 or 83 degrees. FIGS. 19 and 20, which show the sidedness parameter as a function of geometric mean tensile for the Northern and Southern furnish tissues respectively. Further illustrates the lower sidedness obtained with the lower creping angle.

EXAMPLE 17

The tissue base sheets were water formed and consisted of 3 layers. The air side layer, which composed 25% of the total sheet consisted of 100% Eucalyptus. The center layer made up 50% of the sheet and was made of a 30/40/30 blend of Southern softwood kraft, chemithermomechanical pulp, and HBA commercial pulp which provides bulk. The remaining 25% of the sheet comprised the Yankee layer which was composed of 100% Northern softwood kraft. Only a single strength level was made. The machine speed for this experiment was 3330 ft/min and the crepe ratio was 19%. The tissue base sheets were made with either an 85 or a 70 degree creping angle which was achieved by changing the blade angle from 15 to 30 degrees. The crepe blade itself had a bevel of 10 degrees. As shown in Table III, softener was not added to the furnish but a total of 13 pounds of starch per ton of furnish were utilized. One pound of the starch was added to the Yankee layer furnish and 12 pounds was added to the middle layer furnish.

The base sheets from this experiment were converted using the Tl emboss pattern. The emboss depth employed was 0.092". The sheets were embossed with their Yankee sides against the steel emboss roll.

Table XII compares the relevant sheet properties for the tissues whose base sheets were manufactured using the different creping angles. As was the case in the previous examples, the friction deviation values for the air and Yankee sides are closer together for the product whose base sheet was creped at 70° than for the tissue made from the base sheet that employed an 85° crepe angle.

TABLE XI

Physical Properties of Embossed Tissue Products

| Creping Angle (deg) | Basis Weight (lbs/rm) | GM Tensile (g/3") | Friction Deviation Yankee Side (GMMMD) | Friction Deviation Air Side (GMMMD) | Sidedness Parameter |
|---|---|---|---|---|---|
| 85 | 16.08 | 494 | 0.199 | 0.219 | .229 |
| 70 | 15.84 | 468 | 0.200 | 0.204 | .206 |

In addition to reducing two-sidedness, using a lower creping angle will also result in increased base sheet thickness, which will aid the ability to generate the desired embossed caliper and should aid in the consumers perception of the tissue's bulk or thickness. For Example 15, no increase in thickness was seen with the lower crepe angle; this is probably due to the fact that the sheets contained HBA commercial pulp which provides bulk; the contribution of this bulking fiber to the sheet's thickness overshadowed any effect due to creping angle. However, in both Example 16 and Example 17 increases in base sheet caliper were seen. For Example 17, the base sheet results are shown in Table XIII for calendered base sheets.

TABLE XII

Physical Properties of Base Sheets

| Creping Angle (deg) | Basis Weight (lbs/rm) | Caliper (mil/8sh) | MD Tensile (g/3") | CD Tensile (g/3") | MD Str (%) | CD Str (%) |
|---|---|---|---|---|---|---|
| 85 | 16.5 | 50.2 | 1228 | 598 | 27.4 | 5.8 |
| 70 | 16.4 | 54.6 | 1204 | 614 | 23.0 | 6.0 |

EXAMPLE 18

This example discloses a low sidedness tissue produced by the brushed and embossed process in which the steel pattern roll of the embossing nip engages the Yankee side of the sheet while the rubber roll in the nip engages the air side.

Base sheets were manufactured on a papermaking machine which is a crescent former with a Yankee drier speed of 2,000 ft. per minute. The air side furnish was 100% Northern softwood kraft and was 40% by weight of total sheet. The Yankee side furnish was a mixture of Northern hardwood kraft (30% of layer) and Northern softwood kraft (70% of layer). The Yankee side furnish was 60% by weight of total sheet. As shown in Table III, four pound starch per ton of furnish were added to the Yankee layer. No softener/debonder was used. The starch was added to the Yankee layer of the sheet for strength enhancement.

Base sheets were converted to finished tissue product using the regular emboss pattern and brushed emboss pattern. The summary of test results is listed in Table XIII.

TABLE XIII

The Physical Properties of Tissue Products

| Product | Embossing Depth (0.001") | Caliper (0.001"/8st) | GMT (g/3") | Tensile Modulus (g/% Strain) | Friction Deviation (MMD) | Sidedness Parameter |
|---|---|---|---|---|---|---|
| Base Sheet | | 50.8 | 1688 | 27.3 | 0.207 | 0.21 |
| Regular Embossed | 75 | 54.8 | 1281 | 14.5 | 0.200 | 0.194 |
| Brushed Embossed | | 54.9 | 1544 | 14.3 | 0.202 | 0.188 |
| Regular Embossed | 90 | 55.1 | 1218 | 14.4 | 0.216 | 0.217 |
| Brushed Embossed | | 60.9 | 1377 | 11.9 | 0.203 | 0.201 |

As is evident from the caliper, friction deviation, tensile modulus, and GMT, the embossed sheet converted using brushed emboss roll resulted in tissue with lower sidedness and also produced tissue with lower friction and modulus even at higher strength levels. The lower tensile modulus and friction associated with the brushed emboss process means higher softness of brushed embossed tissue.

EXAMPLE 19

(Control)

This tissue was fiber stratified but not chemically stratified, and the example illustrates that chemical stratification improves the softness and related physical on which acceptable consumer testing results are based on the Monadic HUT. As shown in Table III, the tissue comprises of three layers- The Yankee layer comprised 20% by weight of the total furnish and consisted of Northern hardwood. The middle layer comprised 60% by weight of the furnish and ½ of this middle layer consisted of recycled fiber, ¼ of the middle layer consisted of broke, and ¼ of the middle layer consisted of softwood. The third layer, the air layer, comprised 20% of the furnish by weight and consisted of Northern hardwood.

The procedure of Example 1 was repeated except the base sheet was not chemically stratified. The base sheet was creped from the Yankee with low creping angle of 72° and the creping procedure set forth herein above. The converted paper product formed exhibited a basis weight of 18.6 pounds per 3000 square foot ream, a machine direction GM tensile strength of 900 grams/3 inches, machine direction stretch of 15.4%, a geometric mean tensile modulus of 21 grams/percent strain and an overall surface friction of 0.197. When this tissue was submitted for consumer testing via the Monadic Home Use Test, overall preference was 2.79, overall softness and strength were judged to be 2.79 and 3.34, respectively.

What is claimed is:

1. A single-ply bathroom tissue product having a serpentine configuration comprising single-ply tissue formed by conventional wet pressing of a cellulosic web, adhering said web to a Yankee and creping said web from said Yankee, said tissue comprising at least two structurally uniform but compositionally differentiated strata which are not delaminated from each other including:

a first stratum comprising a major portion of recycle fiber, optionally, cationic nitrogenous softener/debonder, and also optionally, a minor portion of another fiber chosen from the group consisting of hardwood fiber, softwood fiber, and mixtures thereof, and also optionally, strength enhancing agent, said first stratum having been in contact with said Yankee;

a second stratum comprising a major portion of softwood fiber, optionally, cationic nitrogenous softener/debonder and optionally, a minor portion of another fiber chosen from the group consisting of hardwood fiber, recycle fiber, and mixtures thereof, and also optionally, strength enhancing agent;

the amount of recycle fibers in said first stratum being at least about 60% by weight of the first stratum;

the amount of softwood fibers in said second stratum being at least about 60% by weight of the second stratum;

the combined amount of softwood and hardwood fibers in said first stratum being no more than 20% of the combined amount of softwood and hardwood fibers in said second stratum;

the amount of recycle fibers in said second stratum being no more than 20% of the amount of recycle fibers in said first stratum;

the concentration of cationic nitrogenous softener/debonder in said first stratum being from about 2% to no more than 75% of the concentration of said cationic nitrogenous softener/debonder in the second stratum, the overall concentration of said cationic nitrogenous softener/debonder in said single-ply bathroom tissue product being between about 1 to about 8 lbs/ton;

the overall concentration of strength enhancing agent in said single-ply bathroom tissue product being from at least about 1 to about 6 lbs/ton whenever the amount of hardwood in the second stratum exceeds 20%;

the concentration of strength enhancing agent in said second stratum being no more than the greater of about 0.5 lbs/ton or 20% of the concentration of said strength enhancing agent in the first stratum whenever the overall concentration of strength enhancing agent in said single-ply bathroom tissue product exceeds at least about 1 lb/ton;

the relative amounts of softwood fibers, recycle fibers, hardwood fibers, strength enhancing agent, and cationic nitrogenous softener/debonder in each of said strata being selected such that said tissue exhibits:

a sidedness parameter of less than 0.3, a tensile modulus of no more than 32 grams/percent strain, a GM MMD friction of no more than about 0.225, and a cross direction GM tensile strength of at least 200 grams per 3 inches.

2. The tissue of claim 1 wherein the second stratum is the air side stratum.

3. The tissue of claim 1 wherein the strength enhancing agent is water soluble starch.

4. The tissue of claim 1 wherein the amount of recycle fibers in said first stratum is at least about 75% by weight of the first stratum.

5. The tissue of claim 1 wherein the tissue exhibits a sidedness parameter of less than 0.225; a tensile modulus of no more than 27 grams/percent strain; a GM MMD friction of no more than about 0.21.

6. The tissue of claim 3 wherein amylose and amylopectin content of the starch is in the range of about 1 to about 30 and about 99 to about 70 percent respectively.

7. The tissue of claim 1 having a basis weight of at least ten pounds per three thousand square foot ream.

8. The tissue of claim 7 having a basis weight of about 10 to about 27 pounds per three thousand square foot ream.

9. The tissue of claim 1 exhibiting a sidedness parameter in the range of about 0.1 to about 0.225.

10. The tissue of claim 1 wherein the crepe angle is controlled to form an angle of less than 80°.

11. The tissue of claim 10 wherein the crepe angle is controlled to form an angle of about 70 to about 78°.

12. The tissue of claim 1 wherein about 0.1 to about 10 pounds of the cationic softener/debonder are added for each ton of furnish.

13. The tissue of claim 1 wherein the nitrogenous softener/debonder is selected from the group consisting of imidazolines, amido amine salts, linear amido amines, tetravalent ammonium salts, and mixtures thereof.

14. The tissue of claim 1 wherein the salt has the following structure:

$$[RCO)_2EDA]HX$$

wherein EDA is a diethylenetriamine residue, R is the residue of a fatty acid having from 12 to 22 carbon atoms, and X is an anion.

15. The tissue of claim 1 wherein the salt has the following structure:

$$[RCONHCH_2CH_2)_2NR']HX$$

wherein R is the residue of a fatty acid having from 12 to 22 carbon atoms, R' is a lower alkyl group, and X is an anion.

16. The tissue of claim 13 wherein the softener/debonder is a mixture of linear amido amines and imidazolines of the following structure:

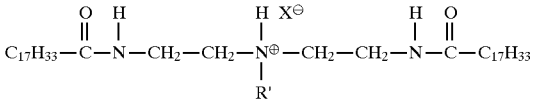

(i)

and

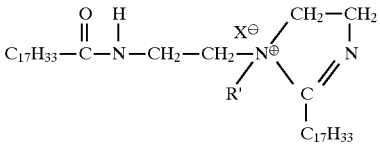

(ii)

wherein X is an anion.

17. The tissue of claim 1 wherein about 0.1 to about 0.3 pounds of the nitrogenous adhesive are added for each ton of fiber in the furnish.

18. The tissue of claim 17 wherein the nitrogenous adhesive is a glyoxylated polyacrylamide or a polyaminoamide.

19. The tissue of claim 18 wherein the glyoxylated polyacrylamide moiety is in the form of a blend or in the form of a terpolymer comprising polyacrylamide of at least 40 weight percent and glyoxal at least 2 weight percent.

20. The tissue of claim 1 wherein the tissue has undergone an embossing process wherein the hard pattern roll of the embossing nip engages the Yankee side of the sheet while the rubber roll in the nip engages the air side.

21. The tissue of claim 1 wherein the tissue exhibits a sidedness parameter of less than 0.225; a tensile modulus of no more than 27 grams/percent strain; a GM MMD friction of no more than about 0.21.

* * * * *